US010472796B2

(12) United States Patent
Woodward

(10) Patent No.: US 10,472,796 B2
(45) Date of Patent: Nov. 12, 2019

(54) ROCK BLADE

(71) Applicant: William D. Woodward, Tyrone, NM (US)

(72) Inventor: William D. Woodward, Tyrone, NM (US)

( * ) Notice: Subject to any disclaimer, the term of this patent is extended or adjusted under 35 U.S.C. 154(b) by 71 days.

(21) Appl. No.: 15/003,529

(22) Filed: Jan. 21, 2016

(65) Prior Publication Data

US 2017/0211256 A1 Jul. 27, 2017

(51) Int. Cl.
*E02F 3/76* (2006.01)
*E02F 3/84* (2006.01)

(52) U.S. Cl.
CPC ..... *E02F 3/76* (2013.01); *E02F 3/7609* (2013.01); *E02F 3/7613* (2013.01); *E02F 3/7618* (2013.01); *E02F 3/7622* (2013.01); *E02F 3/7631* (2013.01); *E02F 3/844* (2013.01)

(58) Field of Classification Search
CPC ... E02F 3/76; E02F 3/844; E02F 3/815; E02F 3/8155
USPC ..... 172/468, 815
See application file for complete search history.

(56) References Cited

U.S. PATENT DOCUMENTS 1,647,680 A * 11/1927 Adams ..... A01B 39/18 172/468
1,964,617 A 6/1934 Bird
2,094,515 A 9/1937 Abbe
2,164,254 A * 6/1939 Olson ..... A01B 35/04 172/468
2,218,512 A * 10/1940 Ball ..... E01H 5/06 172/812
2,623,602 A * 12/1952 Double ..... B60G 99/002 172/811
2,646,850 A * 7/1953 Brown ..... B62D 13/04 172/780
2,990,632 A 7/1961 Noblin
3,337,974 A * 8/1967 Fisher ..... E02F 3/7618 172/824
3,426,458 A 2/1969 Spitzer
3,658,136 A * 4/1972 Ernst ..... A01B 41/02 172/107
3,800,884 A * 4/1974 Estes ..... E02F 3/7663 172/776
4,099,578 A * 7/1978 Stevens ..... E02F 3/8155 172/815
4,150,726 A * 4/1979 Weitlow ..... B62D 13/04 172/711
4,369,847 A * 1/1983 Mizunuma ..... E02F 3/815 172/701.1
4,821,436 A 4/1989 Slocum
5,136,795 A 8/1992 Rosenberg
(Continued)

FOREIGN PATENT DOCUMENTS

EP 2154294 2/2010
FR 2772404 6/1999
JP S5561623 5/1980

*Primary Examiner* — Thomas B Will
*Assistant Examiner* — Joel F. Mitchell
(74) *Attorney, Agent, or Firm* — Peacock Law P.C.; Janeen Vilven; Justin Jackson

(57) ABSTRACT

A movable blade assembly which can be attached to the front or rear of a vehicle and the height of the blade can be adjusted with respect to a roadway such that the blade only comes into contact with relatively large debris and moves them from the roadway.

18 Claims, 40 Drawing Sheets

(56) References Cited

U.S. PATENT DOCUMENTS

| | | | | |
|---|---|---|---|---|
| 5,205,058 | A | 4/1993 | Allen et al. | |
| 5,392,538 | A * | 2/1995 | Geerligs et al. | E01H 5/061 37/236 |
| 5,775,438 | A | 7/1998 | Confoey et al. | |
| 5,806,214 | A * | 9/1998 | Behrens et al. | E01H 5/066 172/274 |
| 5,848,654 | A | 12/1998 | Belcher, Jr. | |
| 5,924,223 | A | 7/1999 | Hone, Jr. | |
| 6,050,008 | A | 4/2000 | Doornek et al. | |
| 6,661,524 | B2 | 12/2003 | Smith et al. | |
| 6,843,001 | B2 | 1/2005 | Jenne | |
| 6,925,735 | B2 | 8/2005 | Hamm et al. | |
| 7,028,460 | B1 | 4/2006 | Fahrenholz | |
| 7,033,105 | B2 | 4/2006 | Catenacci et al. | |
| 7,040,079 | B2 | 5/2006 | Crosby | |
| 7,578,078 | B2 * | 8/2009 | Gandolfi | E01H 5/066 172/815 |
| 7,617,882 | B1 * | 11/2009 | Street | E02F 3/3604 172/817 |
| 8,418,777 | B1 | 4/2013 | Grossen | |
| 2005/0126051 | A1 | 6/2005 | Fatemi | |
| 2015/0060097 | A1 * | 3/2015 | Biggs et al. | E02F 3/8152 172/772.5 |

* cited by examiner

ROCK BLADE

BACKGROUND OF THE INVENTION

Field of the Invention (Technical Field)

Embodiments of the present invention relate to a rock blade, which can be used, for example in an open pit mining or quarrying application.

Description of Related Art

Currently in open pit mining or quarrying applications, spillage from haul trucks creates obstacles, such as sharp rocks, on the haul road. These obstacles can drastically shorten the useful life of haul truck tires. Some of the larger tires used in such operations often cost upwards of $90,000 each. Lost production efficiency and capital loss are a direct result of lost time due to the necessity of changing and/or repairing ruined tires. The current practice for handling spillage is the employment of rubber tired dozers and graders to clean rocks off of the road. This additional equipment increases traffic congestion, which in turn increases hazards in the work area.

Safety is a primary concern at all times in these types of operations. The enormous size, limited visibility and distance required to stop a loaded haul truck creates a constant high energy hazard within operations. Haul trucks have a large area directly in front of the operator's compartment where the view is blocked by the upper deck. This is referred to as the "Blind Spot". The large production haul trucks, common in open pit mine operations, have a blind spot of 44 feet. Numerous accidents have occurred when smaller vehicles have been lost in the blind spots of haul truck operators, who subsequently have driven over the smaller trucks. These loaded trucks easily flatten the majority of other support equipment used in the operations including full sized pickups.

A rear end collision between two haul trucks can result in serious injury or death. This is partly because such large trucks do not have a rear bumper to absorb an impact. As such, the rear of the dump bed or "dove tail" of the truck in front collides with the operator cab of the trailing haul truck. There is thus a present need for an invention which not only helps clear haul roads of sharp rocks which damage expensive tires, but which also provide improved safety in the event of an accident with support equipment or a rear end collision between two haul trucks.

BRIEF SUMMARY OF EMBODIMENTS OF THE PRESENT INVENTION

An embodiment of the present invention relates to an apparatus comprising at least two blades, the blades movable independently with respect to one another and positioned such that a primary axis of each of the blades is substantially parallel with one another, the blades not contacting a surface on which the vehicle traverses when the apparatus is in use, the apparatus attachable to a vehicle. Optionally the blades can be substantially planar and are not curved. The apparatus can also comprise a frame and at least two wheels. A plurality of hydraulic cylinders can be provided which raise and lower the apparatus with respect to the vehicle. Optionally, at least one hydraulic cylinder can be configured to slide at least one of the blades along a direction parallel with its primary axis.

In one embodiment, the apparatus can be folded into a compacted state when the apparatus is raised. Optionally, the apparatus can comprise a mounting structure that accommodates mounting onto a haul truck.

An embodiment of the present invention also relates to an apparatus having a plurality of blades, the blades arranged substantially parallel with one another but not arranged coplanar with one another, the apparatus attachable to a vehicle, at least one hydraulic cylinder attached to at least one of the blades such that actuation of the cylinder causes the attached blade to move while remaining substantially parallel with other of the blades. A plurality of wheels can be provided and optionally four wheels are provided. Optionally the apparatus can comprise two blades. And, the blades can be mounted such that they can be raised and lowered together and yet remain independently movable with respect to one another. Preferably, a slack adjuster can also be provided. The apparatus can include a plurality of wheels, and at least some of the wheels can fold in when the apparatus is raised.

In an alternative embodiment, the apparatus can include a mount, having dimensions which permit mounting onto a haul truck and at least one blade, the blade not contacting a surface on which the haul truck travels when the apparatus is in a lowered and operational state. Optionally, at least one cylinder can be provided and communicably coupled to the blade so as to cause the blade to traverse in a direction aligned substantially parallel with a primary axis of the blade.

An embodiment of the present invention relates to a rock blade which reduces lost production efficiency and equipment availability as a result of unplanned down time of equipment, the financial burden of ruined tires. The rock blade according to an embodiment of the present invention also provides an improvement to the overall safety aspect of the operations. This is because when such an apparatus is attached to a haul truck and a rear impact between two such trucks occurs, the force of the impact will be absorbed partially by the contact of the blade attached to the following haul truck, whose blade will then be shoved forward against the rear tires of the forward truck, thus creating an impact and "crunch zone" created by the design of the blade frame.

When attached to the front bumper of a haul truck, a rock blade according to an embodiment of the present invention will direct larger spillage to the side of the haul road. This is accomplished by adjusting the rock blade such that the blade is disposed a desired height above the road surface. In this manner "sized" material (i.e. gravel) will be left in place and only the larger spillage material is moved to the road's edge. An additional unique feature of an embodiment of the present invention is the ability to move the blade perpendicular to the direction of travel. This aspect allows for one or more of the blades to be fully extended and provide a cleared path of travel in a tight turn. Regardless of the direction the turn is made, this embodiment will provide that spilled material is cleared.

An embodiment of the present invention relates to a rock blade that can be folded up. This is a very practical design for three important reasons. First, such haul trucks are typically loaded by electric shovels over the rear of the trucks. It is not uncommon for spillage of material to travel over the front of the vehicle and land several feet in front of the truck. With a rock blade attached and folded up, there is a lower likelihood of large boulders landing on the blade if such is disposed and in the raised/folded position in front of the rock truck. Second, on occasion, these haul trucks will need to be towed to a shop complex for repair. The attachment point for the wrecker truck is typically on the bottom of the front bumper of such haul trucks. An embodiment of the present invention provides an access to this point without the need to remove any part of the blade. Third, occasionally haul trucks operate in relatively confined locations. For example newly constructed drop cuts to create a lower bench. In these circumstances a haul truck has a much smaller area to turn around in and back under a shovel. It is not uncommon for a haul truck to initiate a turn by traveling forward until the front bumper of the truck comes into contact with the wall of the drop cut face and then finish the turn while backing up. Because an embodiment of a rock blade is capable of being folded up, the blade can thus be folded up so as not to diminish the truck's ability to operate in these tight quarters. In the event that a haul truck comes into forward contact with a smaller vehicle or piece of support equipment, the rock blade will push the vehicle out of the way, rather than allowing the truck to drive over it. In addition, an embodiment of the present invention can be fitted on rail vehicles and/or highway vehicles that have the kinetic potential to render engineered safety crunch zones of passenger vehicles ineffective.

Objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE SEVERAL VIEWS OF THE DRAWINGS

The accompanying drawings, which are incorporated into and form a part of the specification, illustrate one or more embodiments of the present invention and, together with the description, serve to explain the principles of the invention. The drawings are only for the purpose of illustrating one or more preferred embodiments of the invention and are not to be construed as limiting the invention. In the drawings.

DETAILED DESCRIPTION OF THE INVENTION

Figure 1:
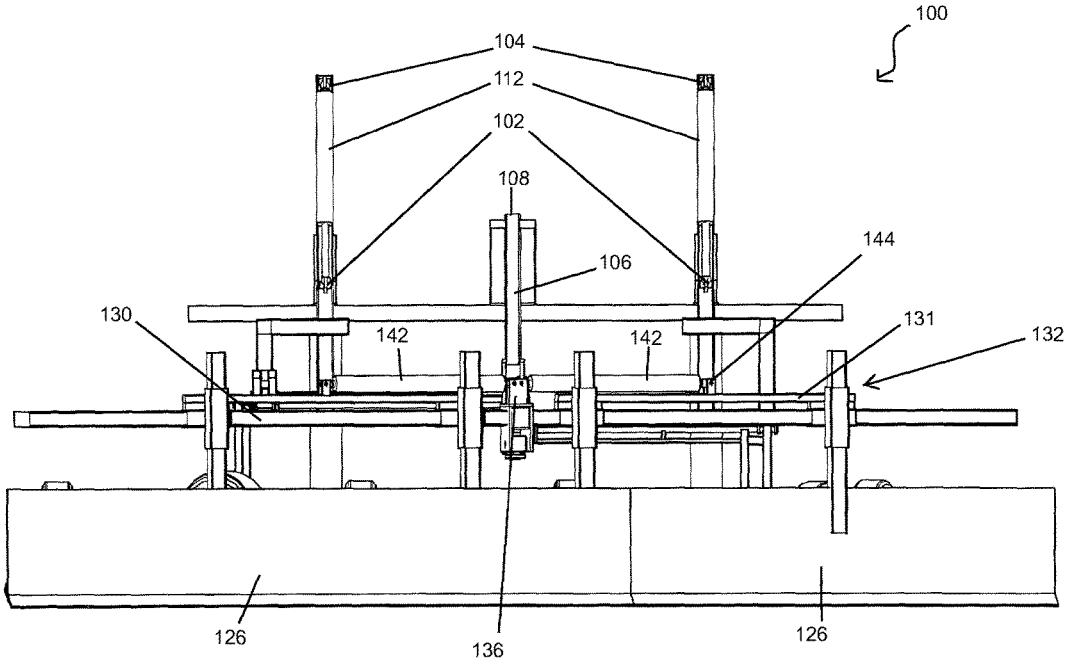
FIGS. 1-6 are drawings which respectively illustrate front, right, rear, left, top, and bottom views of a rock blade in a lowered position according to an embodiment of the present invention.

Referring now to the figures, an embodiment of the present invention relates to a rock blade. More particularly to a rock blade which can be mounted onto the front of a haul truck and which can move large debris, such as rocks, from a roadway or path.

In one embodiment, rock blade 100 can be attached to the front of a haul truck. In one embodiment, rock blade 100 can be afforded with height adjustment ability which permits the apparatus to be raised and lowered with respect to the haul truck to which it is attached. In this embodiment, one or more pivot points 101 are preferably provided. Hoist cylinders 112 are preferably pivotally connected at their lower ends at lower cylinder connection point 102 and at their upper end at upper cylinder connection point 104 and are thus suspended above pivot points 102. Center leveling arm 106 is also preferably pivotally attached the bumper at a levering arm pivot point 108. Optionally, center levering arm 106 is disposed approximately midway between pivot points 102. Thus, all three points of attachment are preferably pivot points with corresponding pins and keepers or some other hinged configuration.

Figure 4:
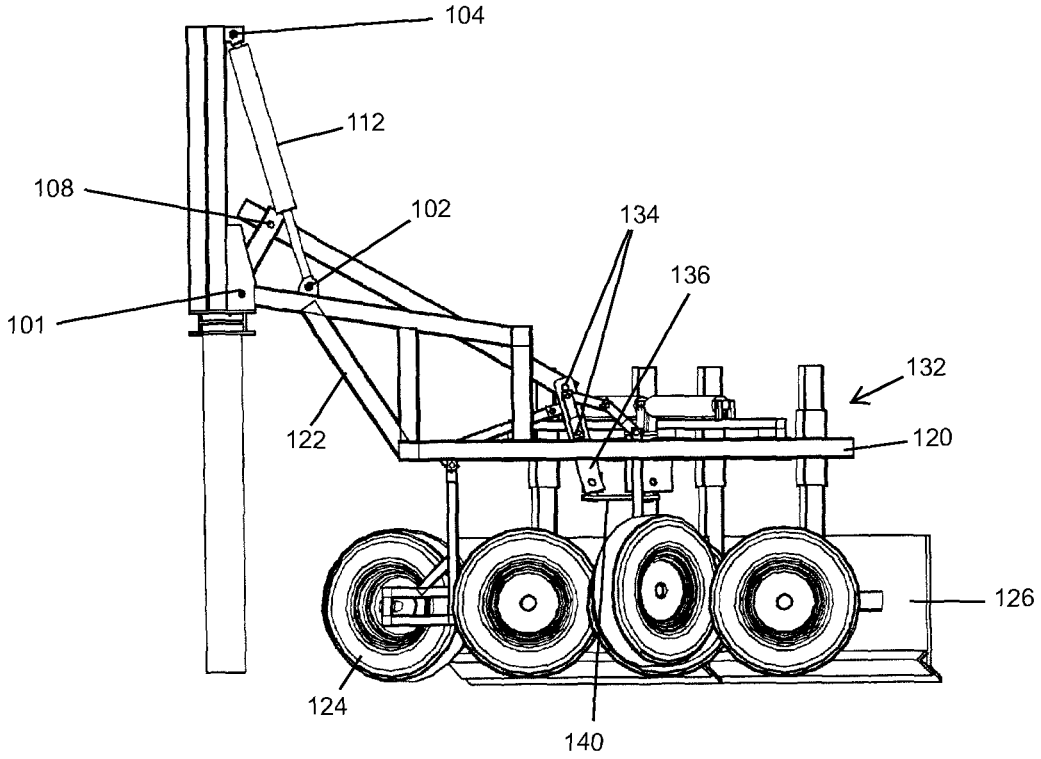
Figure 7:
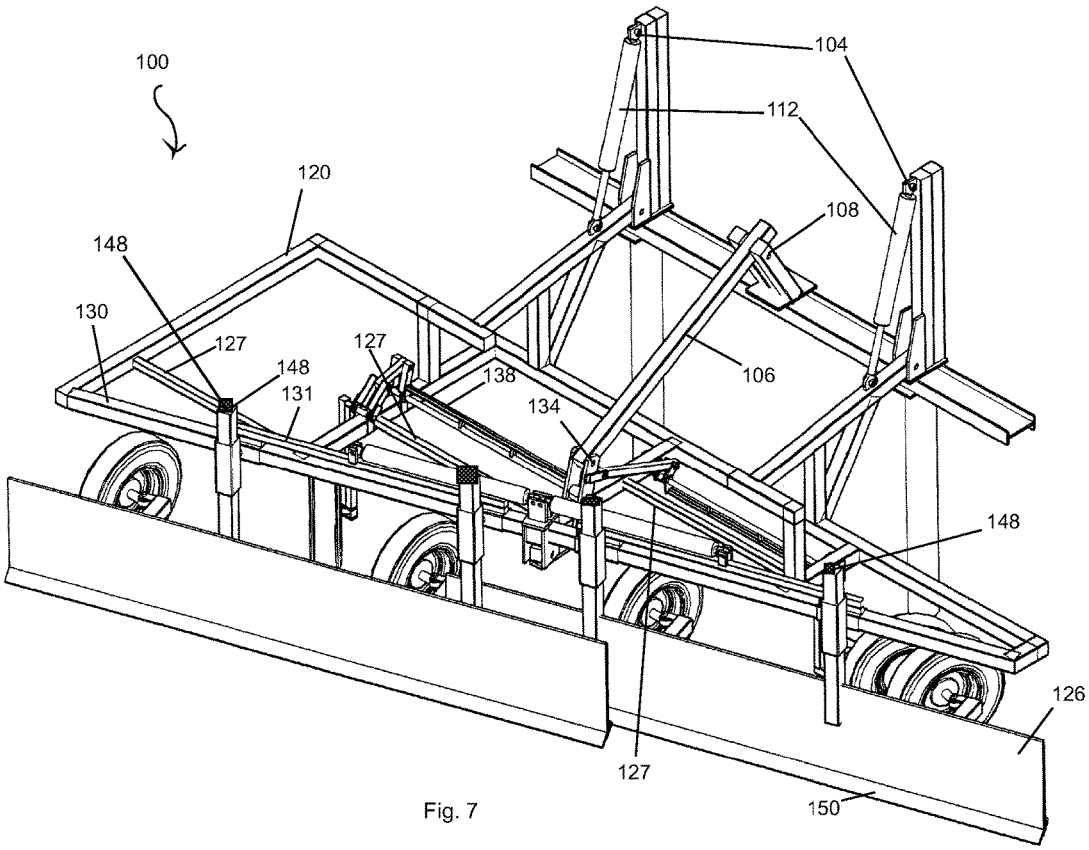
FIGS. 7 and 8 are drawings which respectively illustrate perspective views of the front right top and front right bottom of a rock blade in a lowered position according to an embodiment of the present invention.
Figure 8:
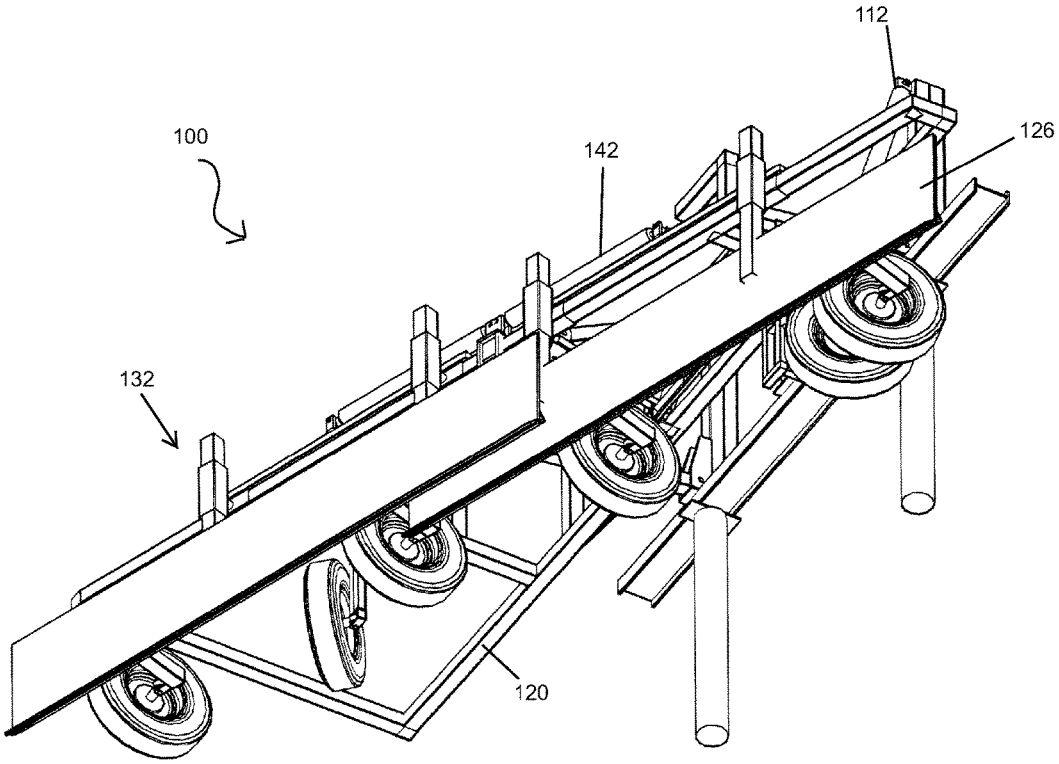
Figure 9:
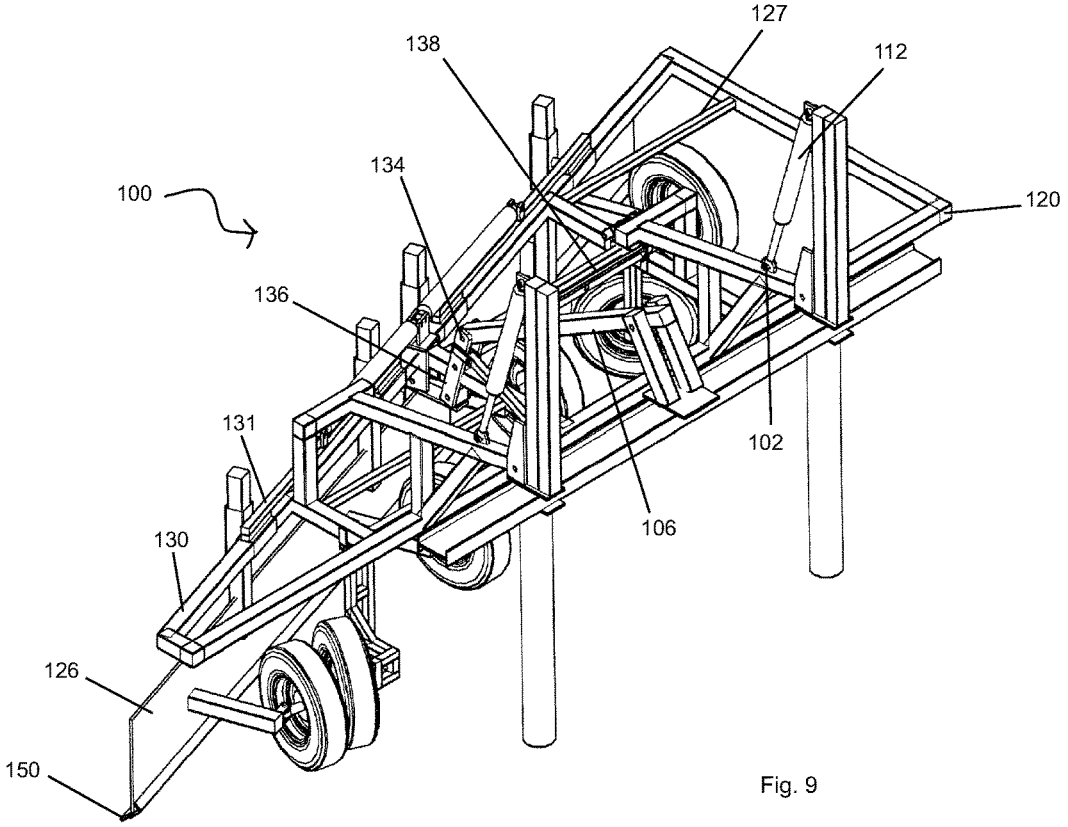
FIGS. 9 and 10 are drawings which respectively illustrate perspective views of the right rear top and right rear bottom of a rock blade in a lowered position according to an embodiment of the present invention.
Figure 10:
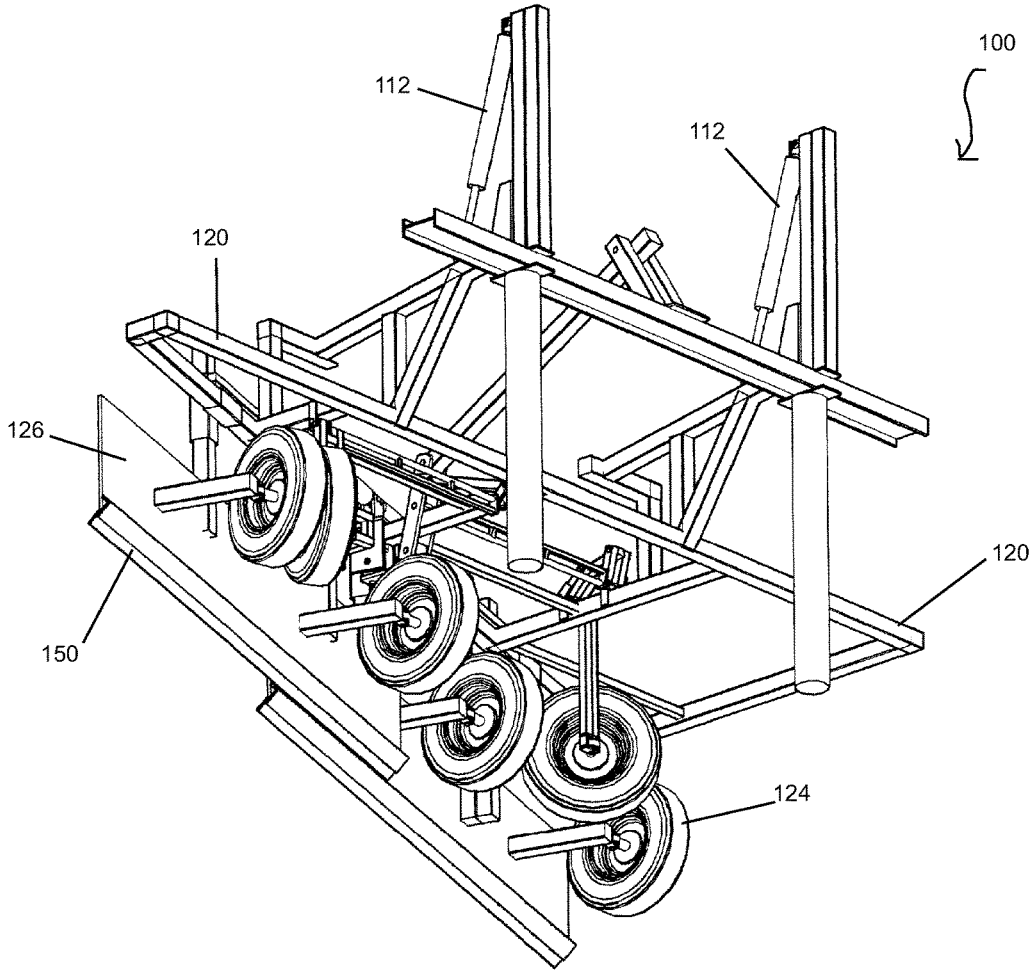
Figure 11:
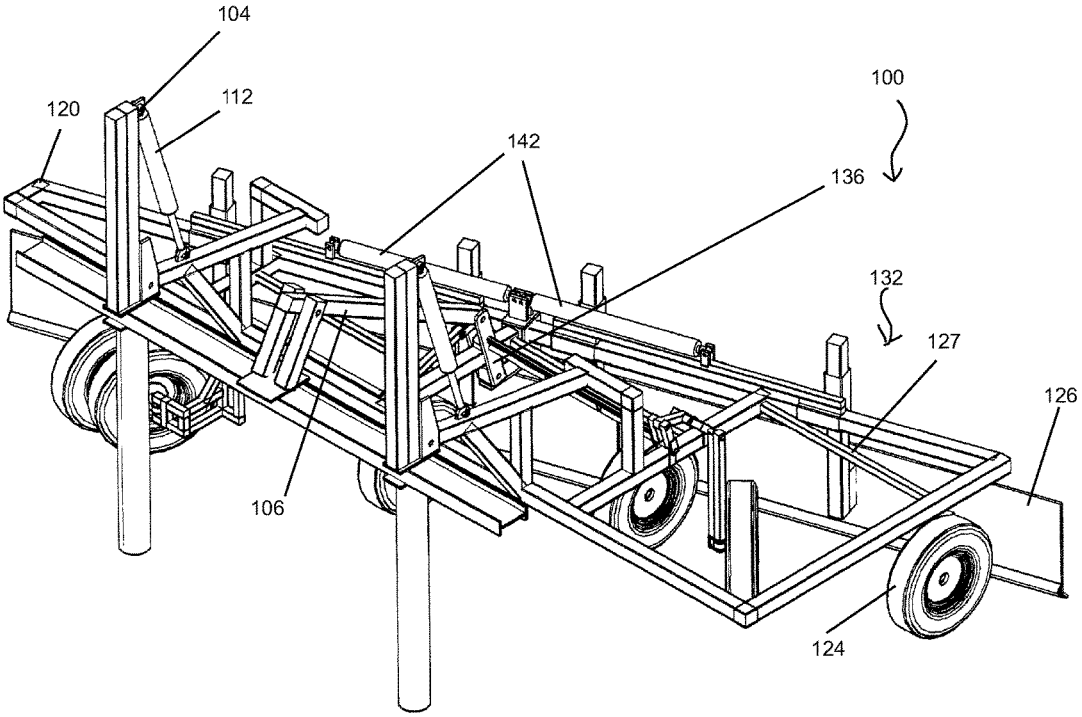
FIGS. 11 and 12 are drawings which respectively illustrate perspective views of the left rear top and left rear bottom of a rock blade in a lowered position according to an embodiment of the present invention.
Figure 12:
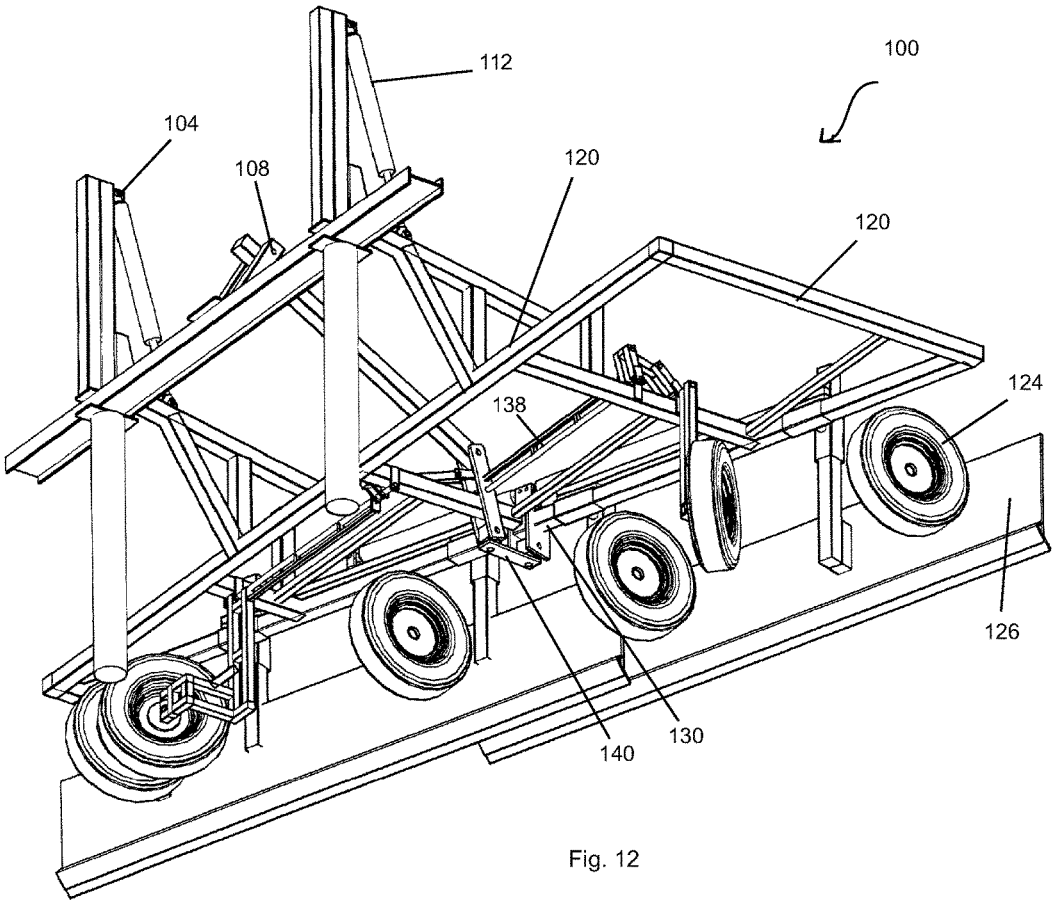
Figure 13:
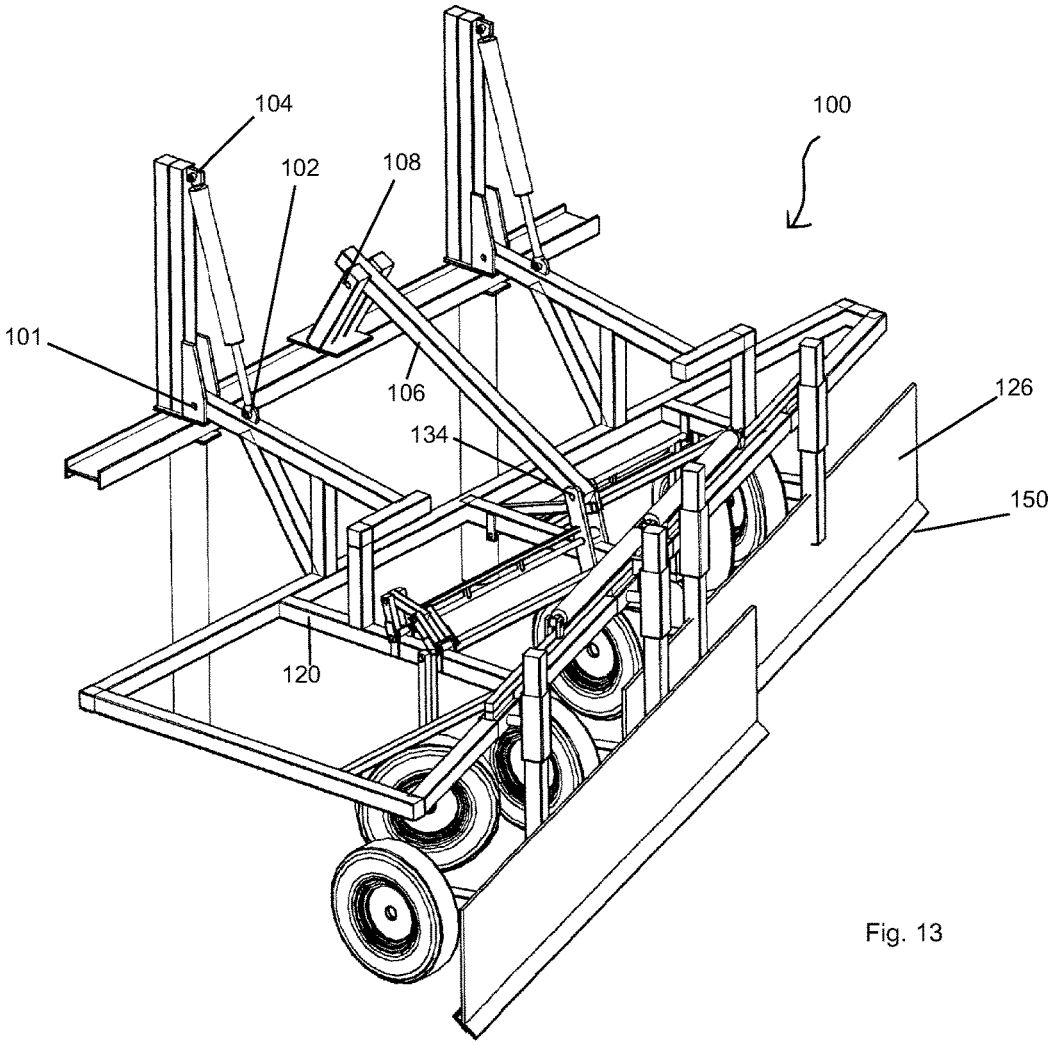
FIGS. 13 and 14 are drawings which respectively illustrate perspective views of the front left top and front left bottom of a rock blade in a lowered position according to an embodiment of the present invention.
Figure 14:
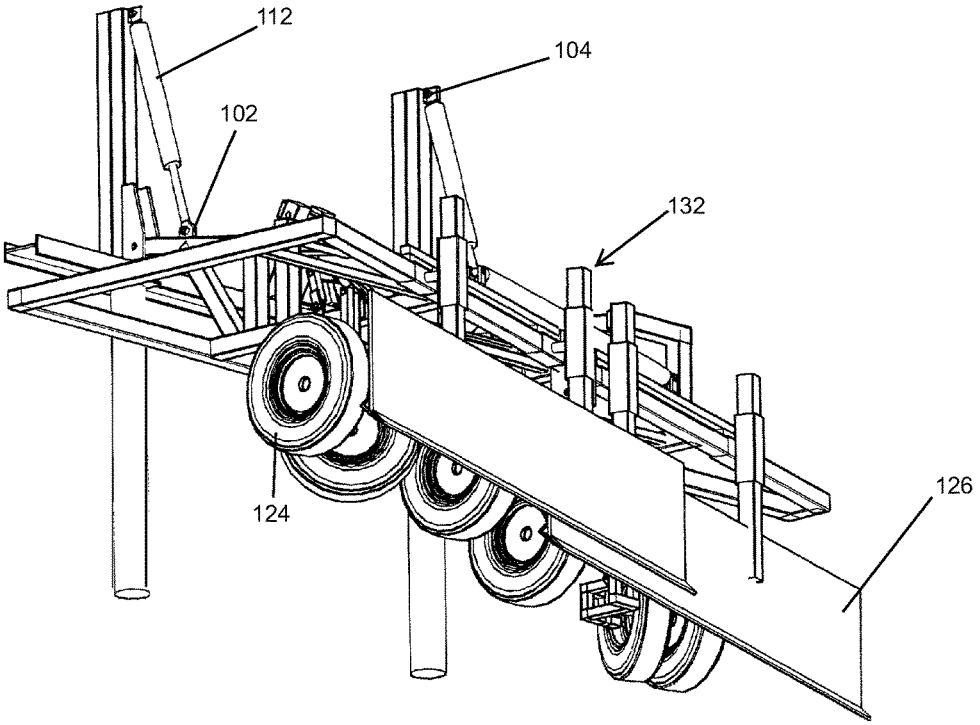
Figure 15:
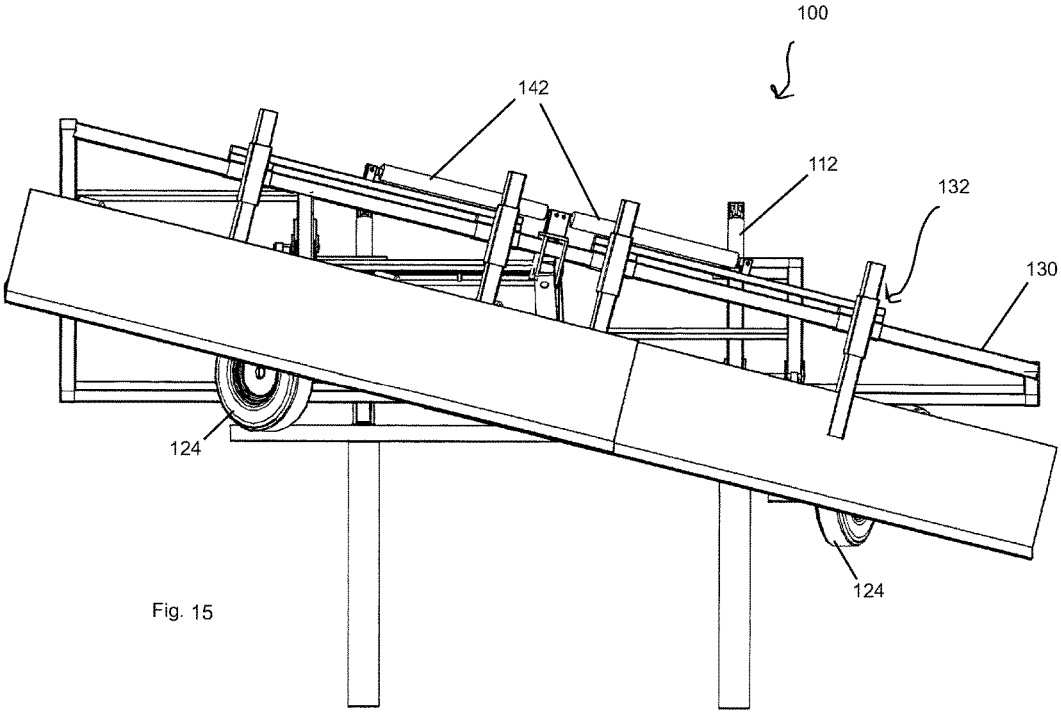
FIGS. 15-20 are drawings which respectively illustrate front, right, rear, left, top, and bottom views of a rock blade in a raised position according to an embodiment of the present invention.
Figure 16:
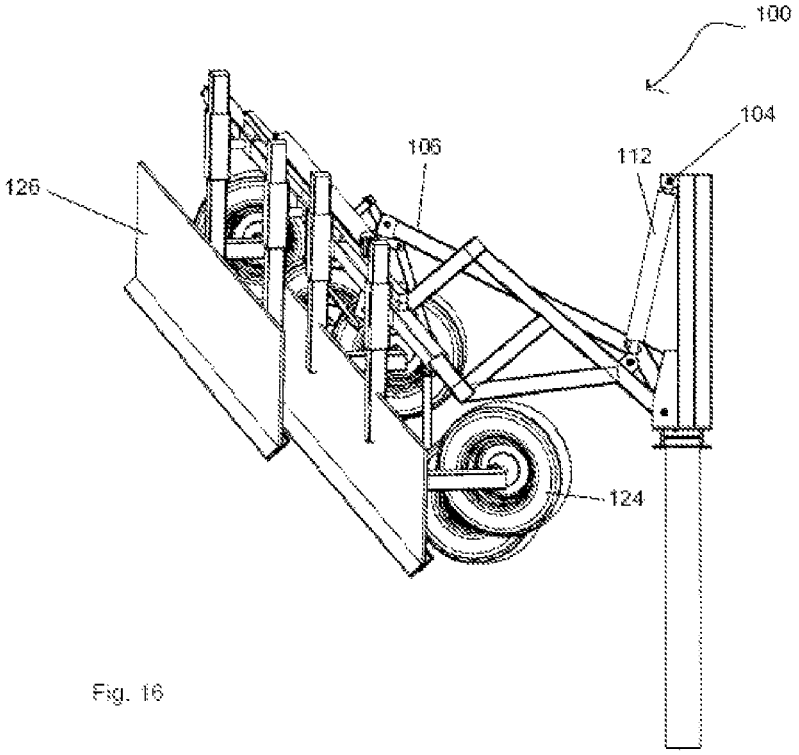
Figure 17:
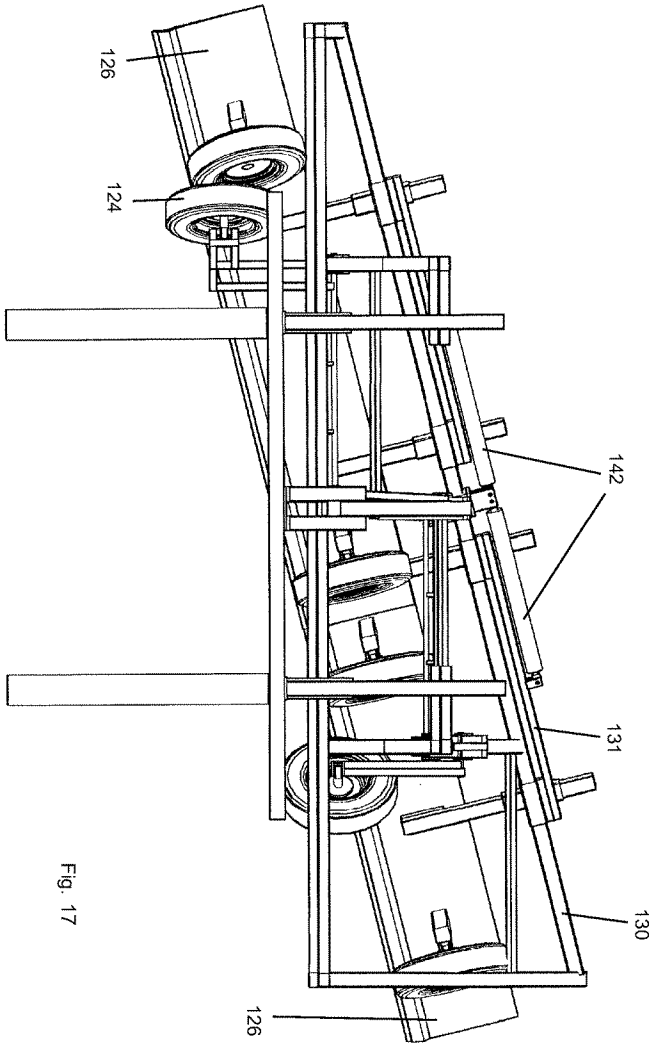
Figure 18:
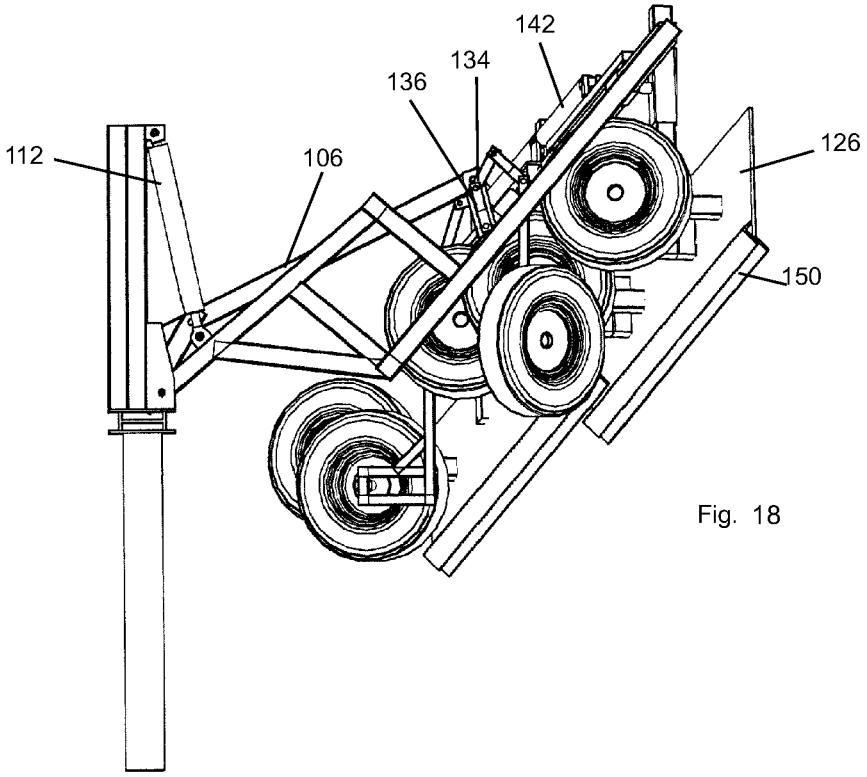
Figure 19:
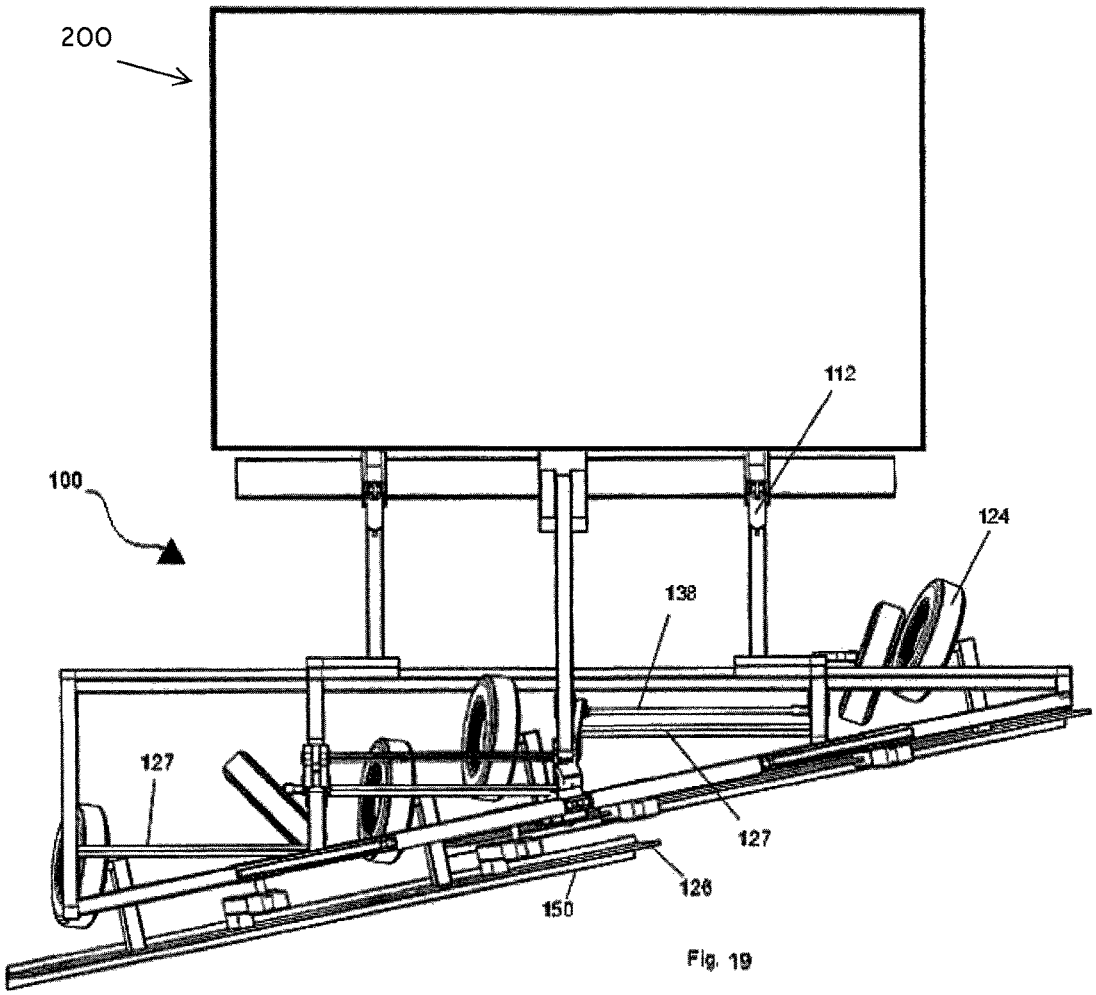
Figure 20:
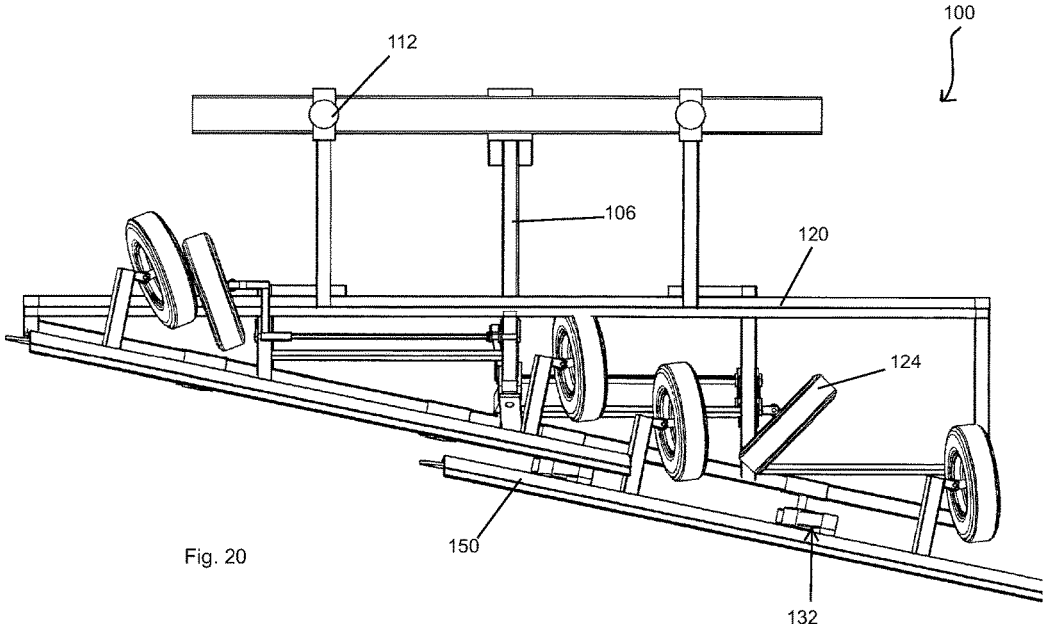
Figure 21:
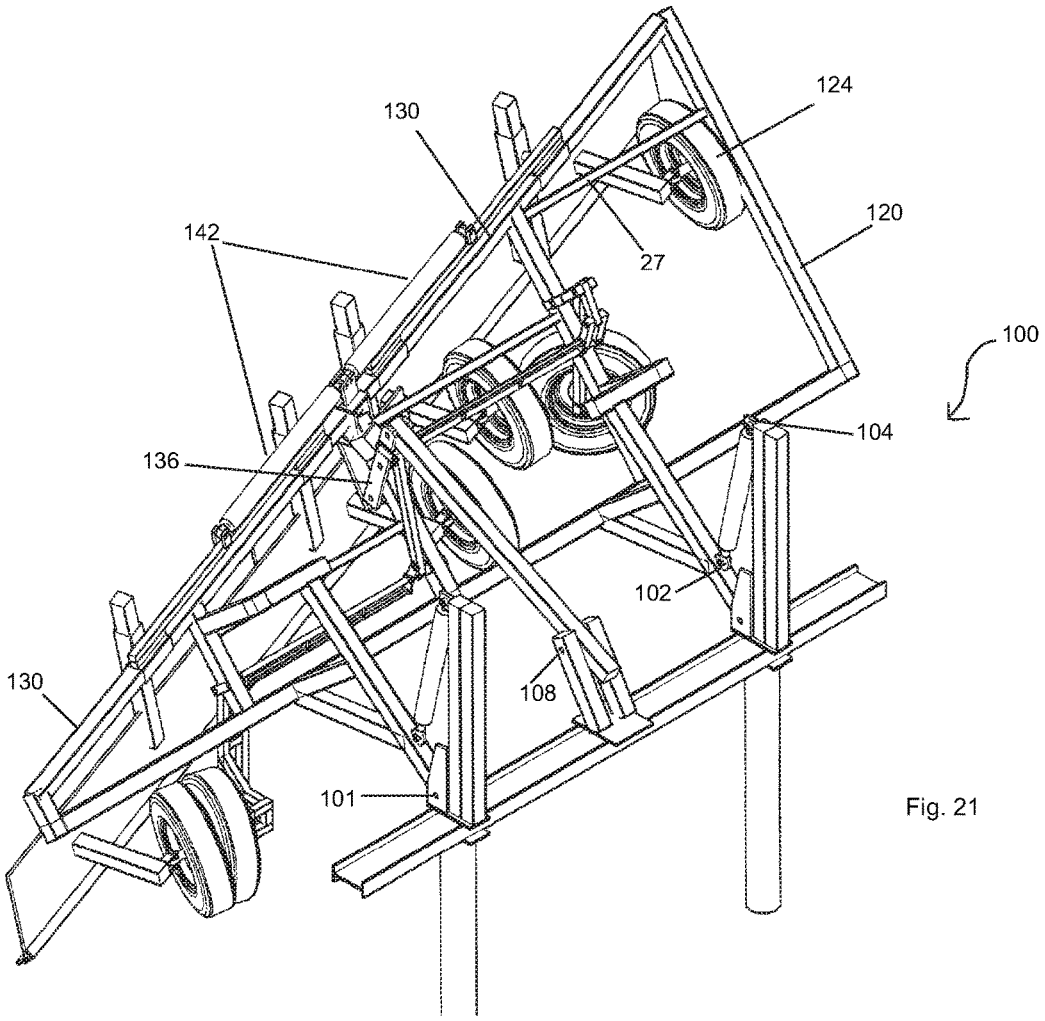
FIGS. 21 and 22 are drawings which respectively illustrate perspective views of the right rear top and right rear bottom of a rock blade in a raised position according to an embodiment of the present invention.
Figure 22:
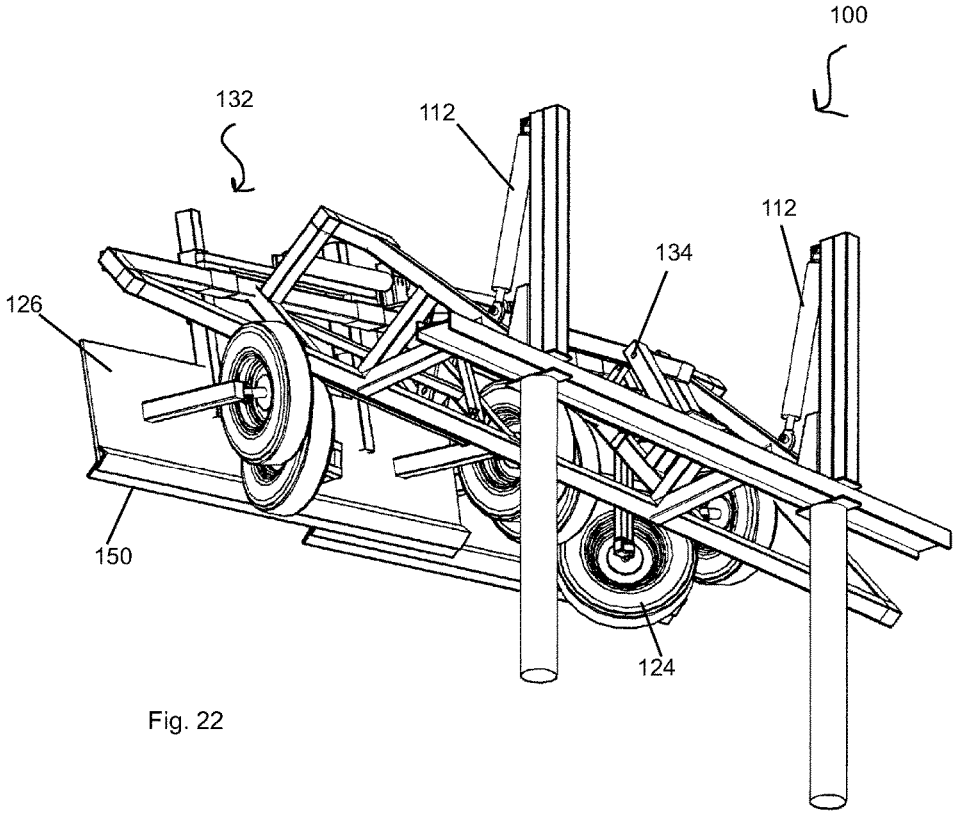
Figure 23:
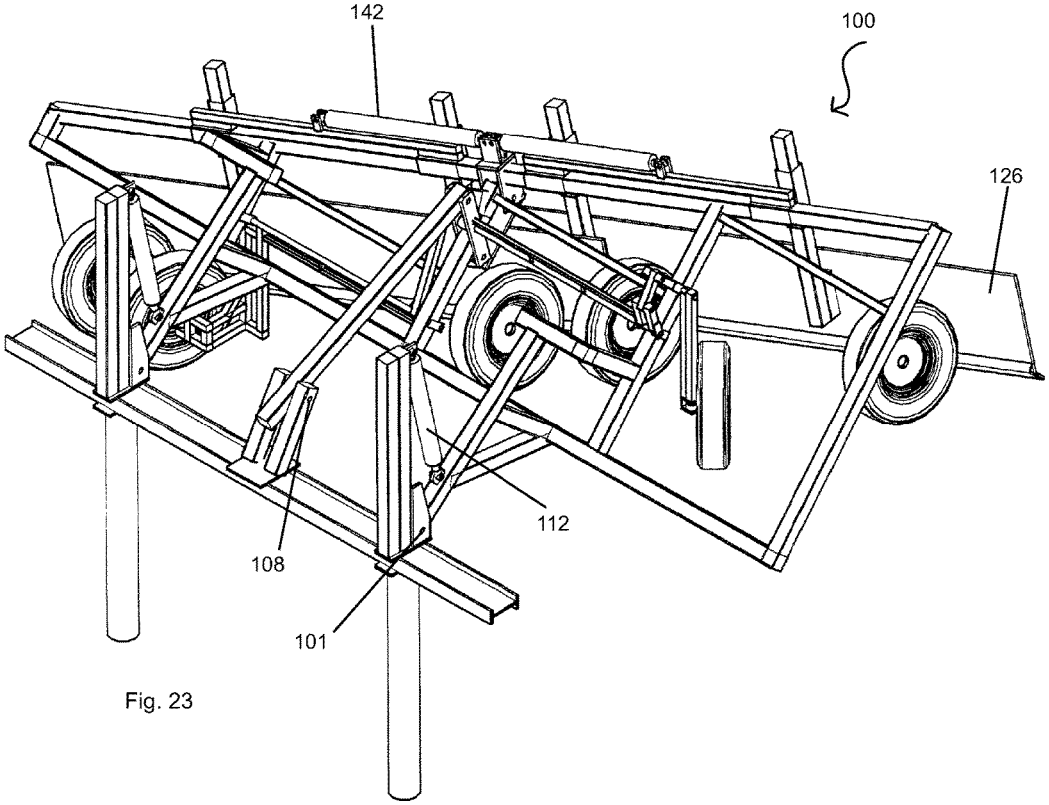
FIG. 23 is a drawing which illustrates a perspective view of the left rear top of rock blade in a raised position according to an embodiment of the present invention.
Figure 24:
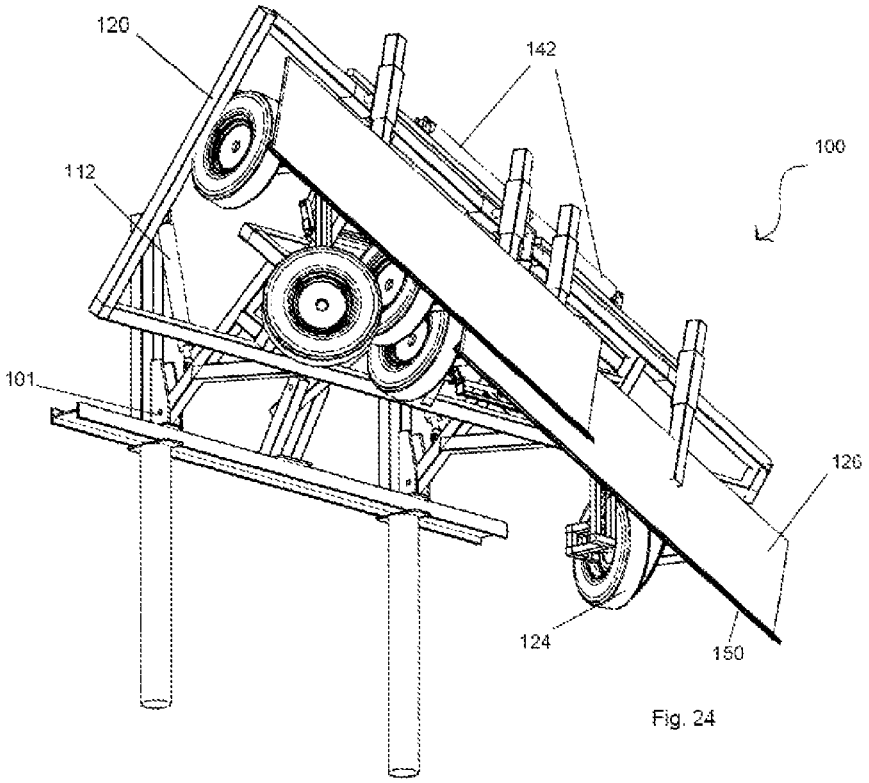
FIGS. 24 and 25 are drawings which respectively illustrate perspective views of the front left bottom and front left top of a rock blade in a raised position according to an embodiment of the present invention.
Figure 25:
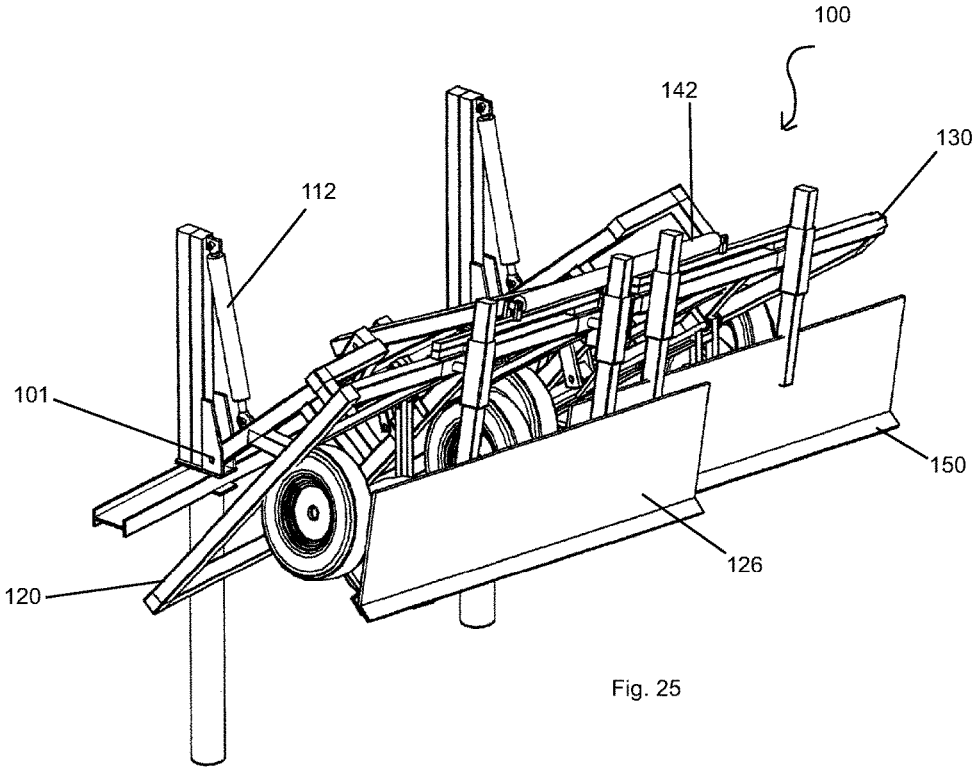
Figure 26:
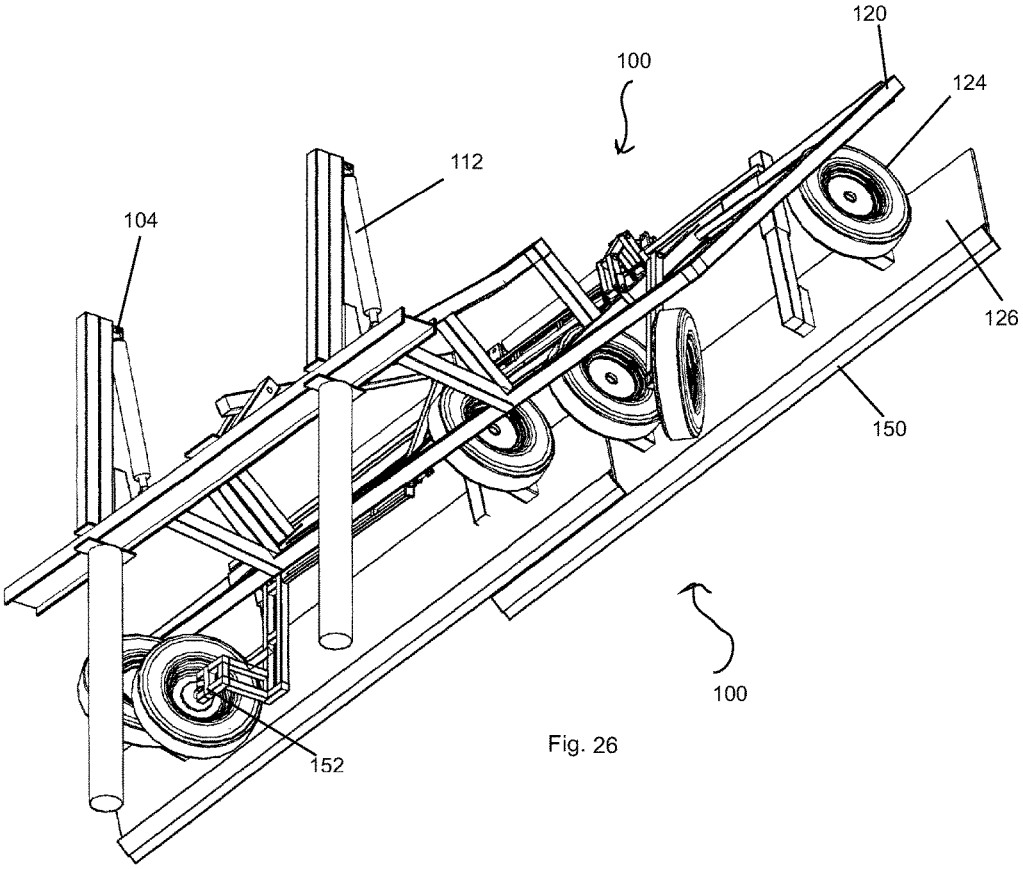
FIG. 26 is a drawing which illustrates a perspective view of the left rear bottom of rock blade in a raised position according to an embodiment of the present invention.
Figure 27:
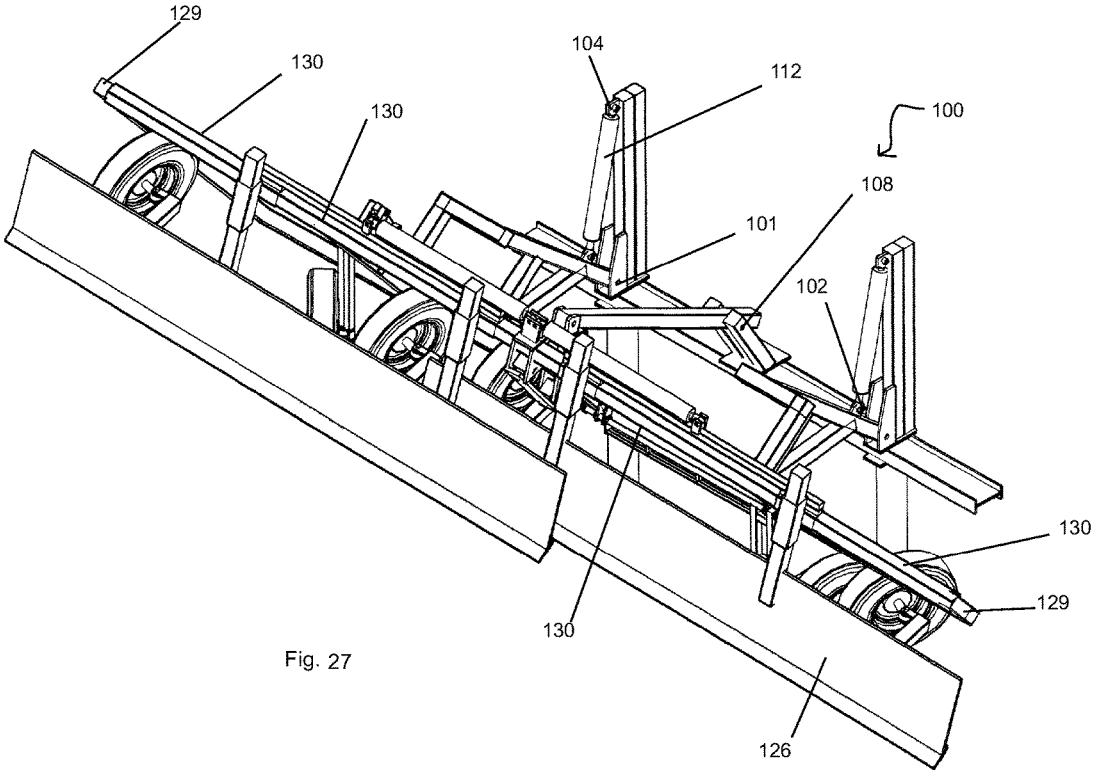
FIGS. 27 and 28 are drawings which respectively illustrate perspective views of the front right top and front right bottom of a rock blade in a raised position according to an embodiment of the present invention.
Figure 28:
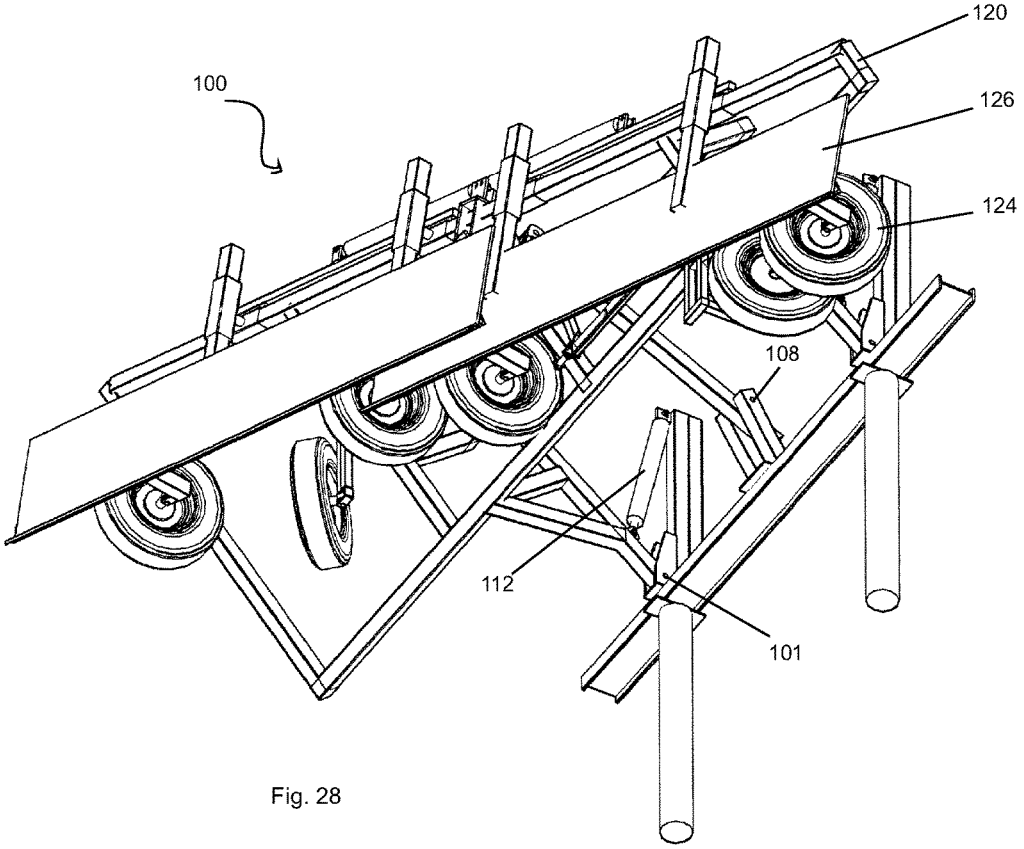
Figure 29:
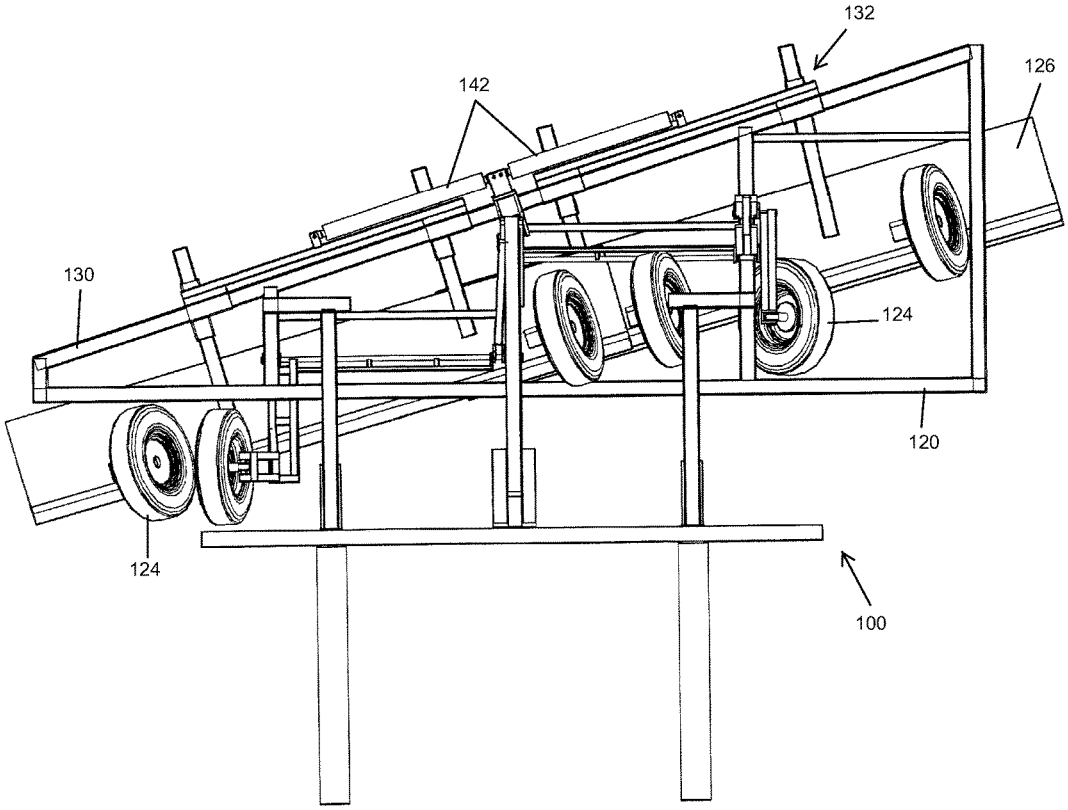
FIG. 29 is a drawing which illustrates a rear view of a rock blade in a raised position according to an embodiment of the present invention.

Support frame 120 preferably extends from pivot points 101. Frame arms 122 (FIGS. 2 and 4) are preferably downsloping to support frame 120. This provides area for wheels 124 and blades 126, such that they can be suspended from the front of the haul truck and can reach the ground. Although support frame 120 can be configured in a number of shapes and will provide desirable results, in one embodiment, support frame 120 is preferably an offset triangular shape. Optionally, structural support beams 127 (FIGS. 5 and 7) can be disposed in one or more locations on support frame 120 to add strength and maintain its structural integrity.

Figure 6:
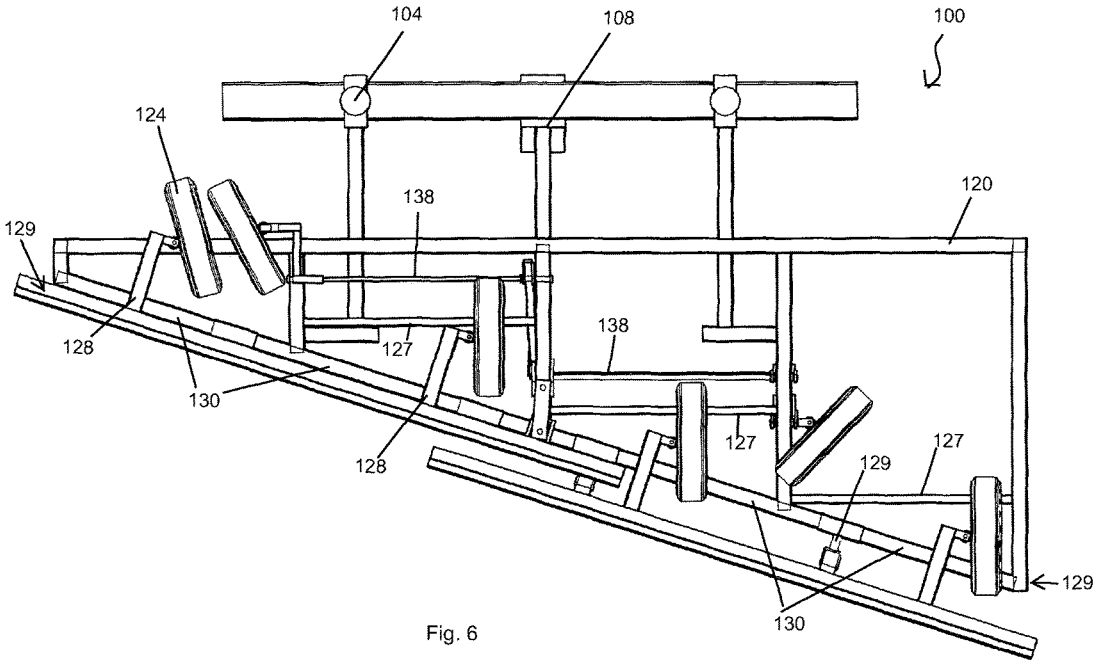
Figure 32:
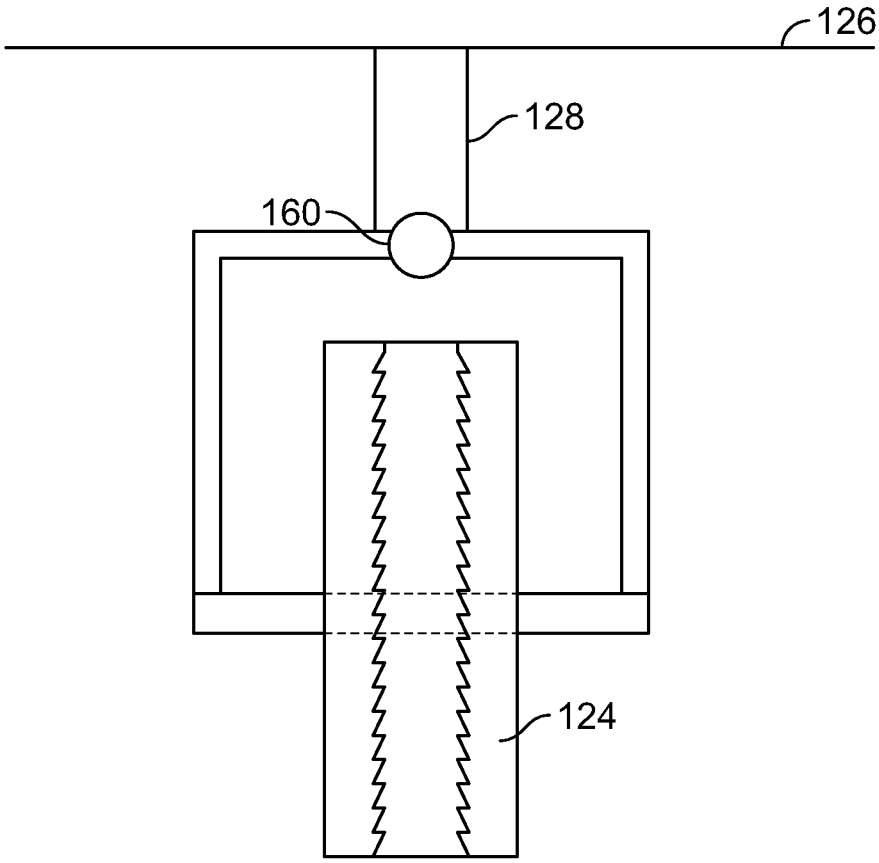
FIGS. 32-34 are drawings which illustrate a castor-type of wheel configuration which can be used for one or more wheels of an embodiment of the present invention.
Figure 33:
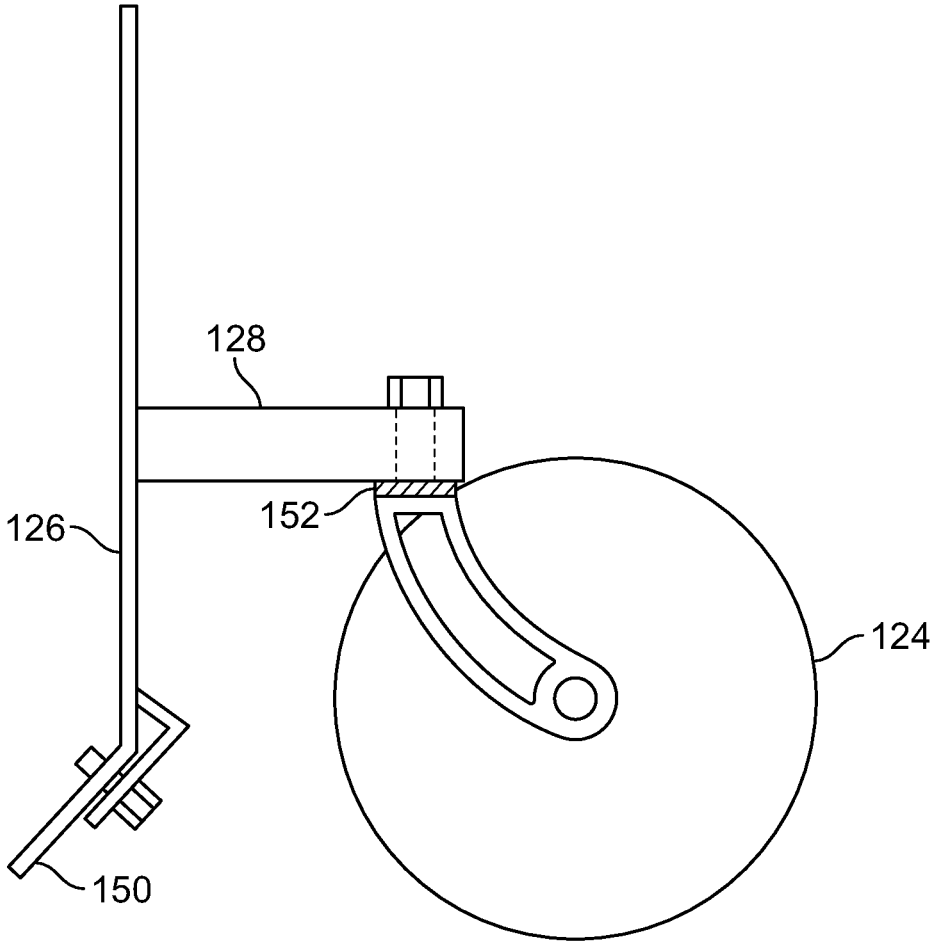
Figure 34:
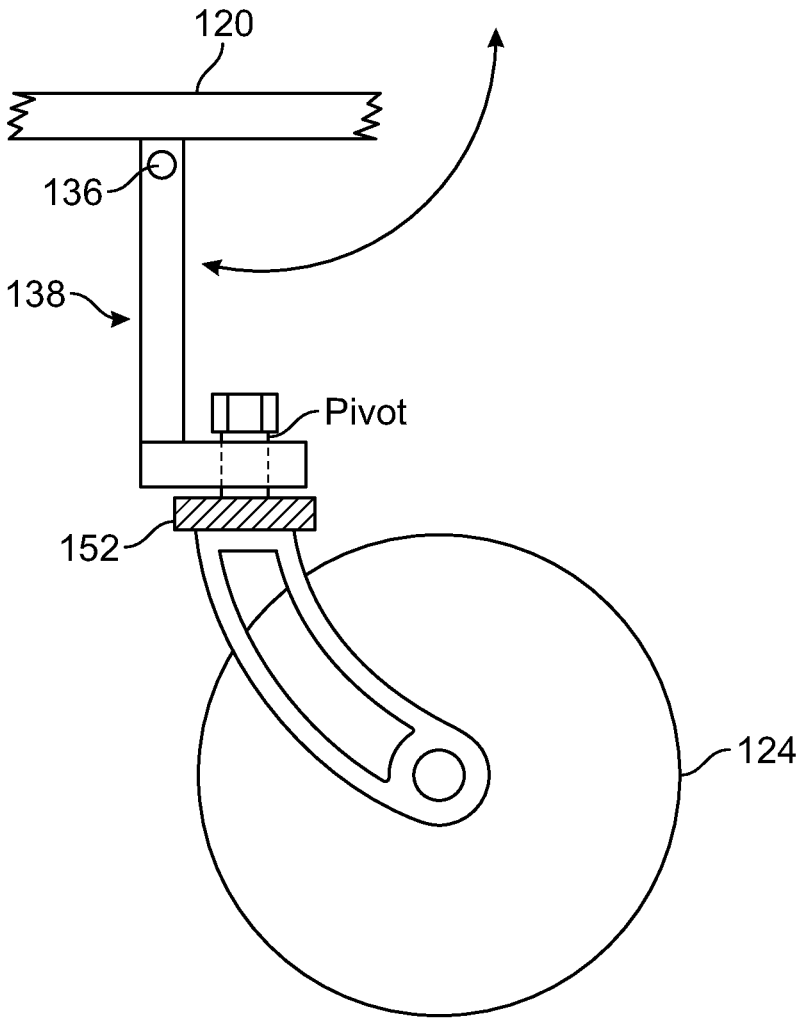
Figure 35:
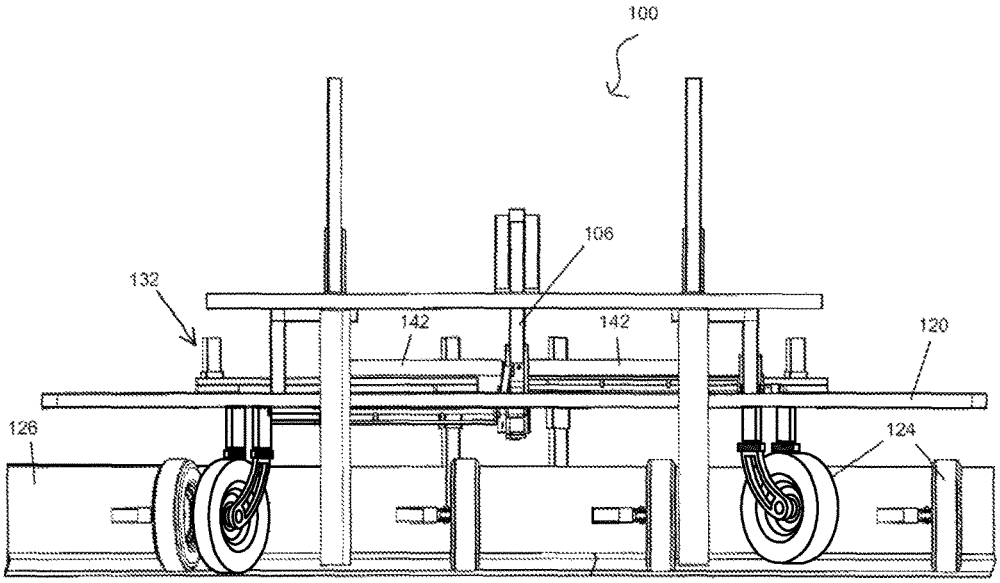
FIG. 35 is a drawing which illustrates an embodiment of the present invention wherein wheels that are attached to the frame are castor-type wheels.
Figure 36:
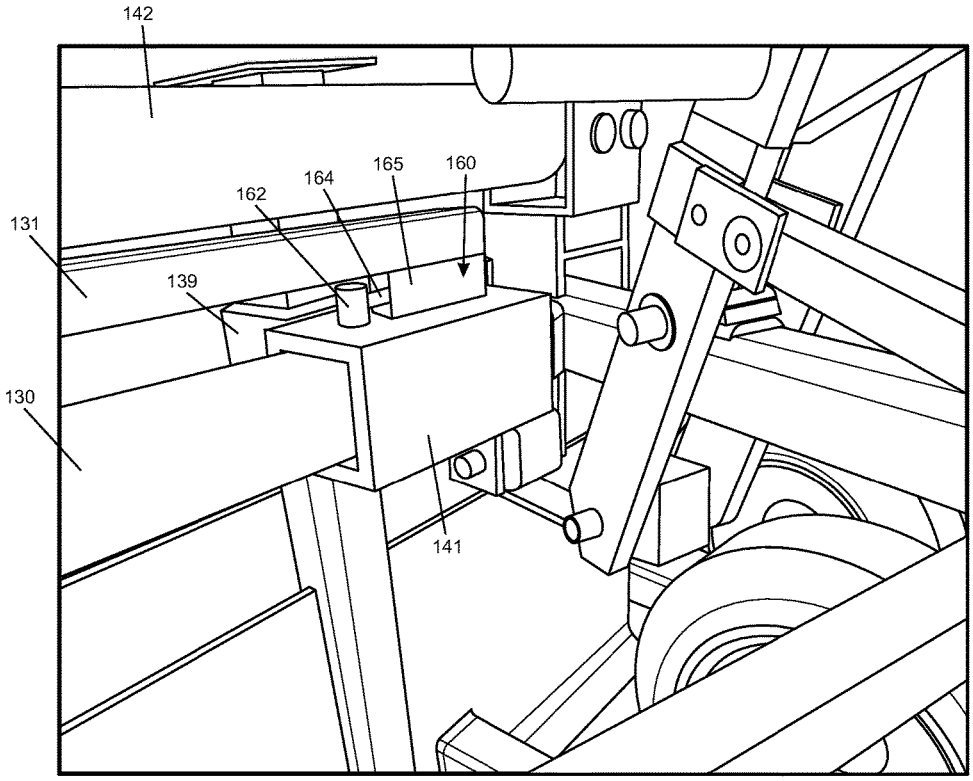
FIGS. 36-39 are drawings which a slack adjuster according to an embodiment of the present invention.
Figure 37:
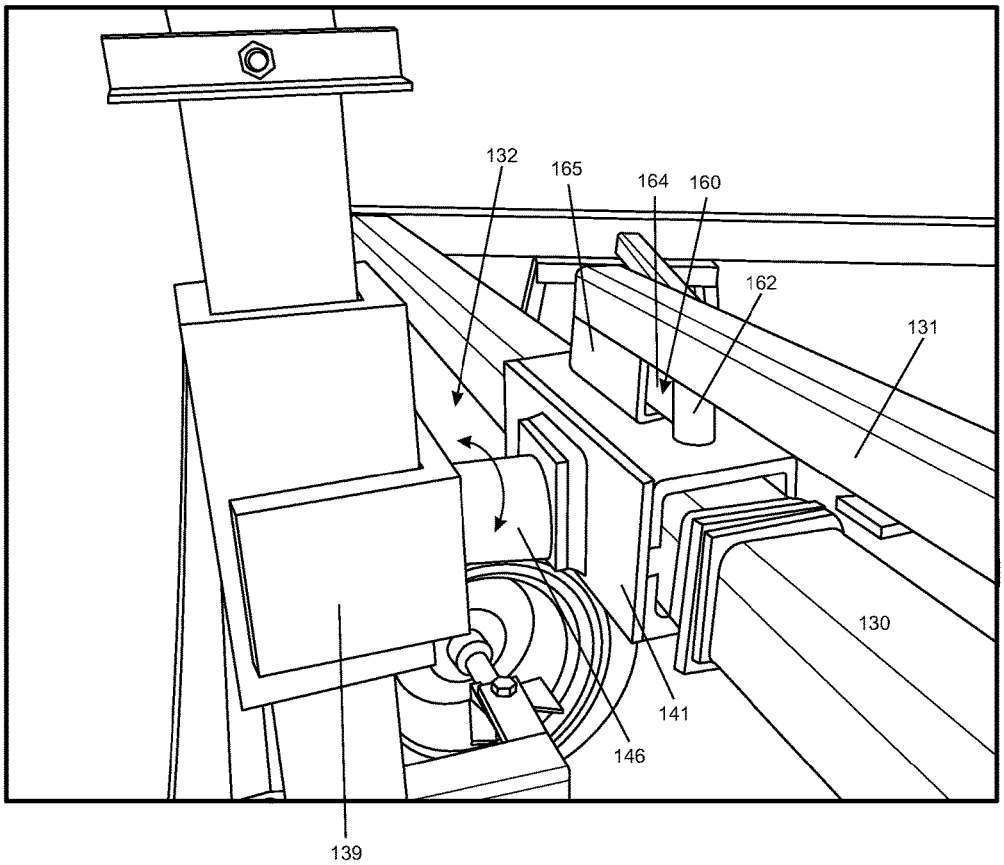
Figure 38:
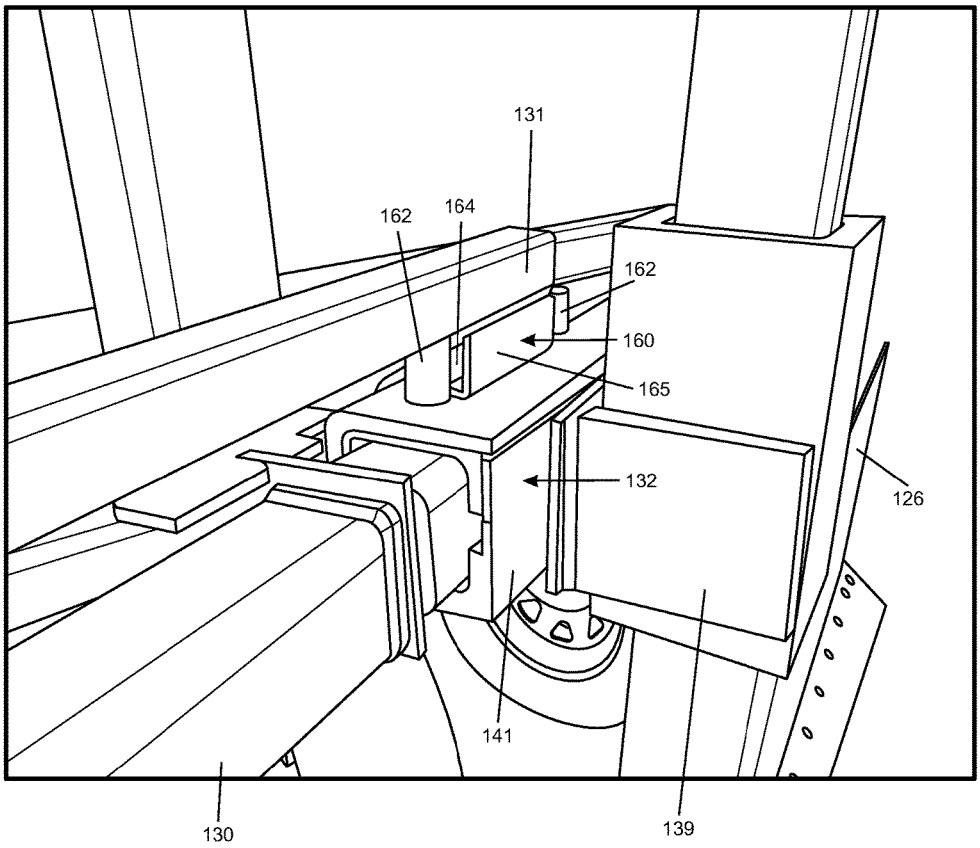
Figure 39:
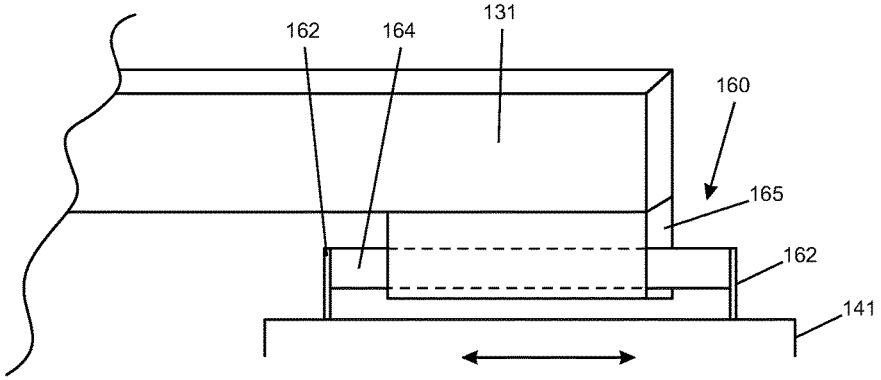

In one embodiment, carriage arms 128 preferably transfer the weight of the various components to one or more of wheels 124 (FIGS. 6, 32 and 33). In one embodiment, there can be one or more pivot points 129 (FIG. 6) (also occasionally referred to throughout the application as pivot points 146) along a length of support frame 120. Preferably, pivot points 129 of blade guides 132 can be in various locations along rotating slide bars 130 (FIG. 6). In one embodiment, two blade guides 132 can be provided for each of blades 126 (FIG. 1). Rotating slide bars 130 can all be in a row and can work in tandem. Preferably, rotating slide bars 130 can pivot about 90 degrees or more. Blade guides 132 (FIG. 1) can be provided and in one embodiment are preferably positioned such that they ride on each section of rotating slide bars 130 via their connection thereto with slack adjusters 160 (FIGS. 36-39). As best illustrated in FIGS. 6 and 37, blade guides 132, preferably comprise pivot point 129 which permits front, vertically orientated portion 139 of blade guide 132 to at least partially rotate with respect to horizontal rear portion 141 of blade guide 132.

Figure 2:
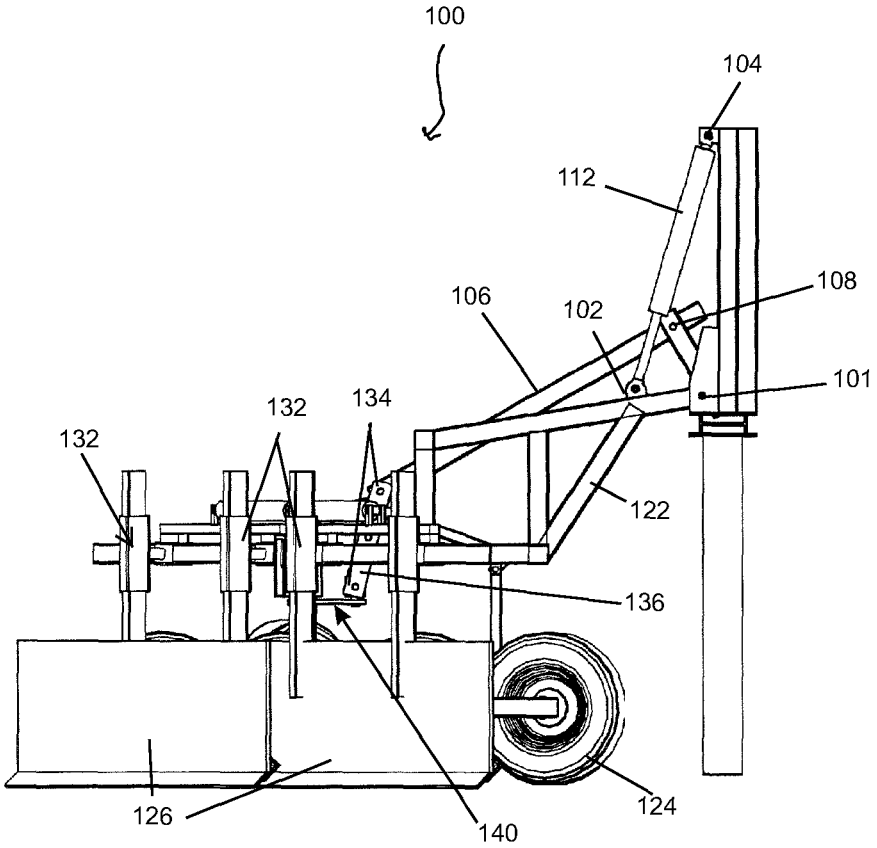

Center leveling pivot points 134 (FIGS. 2 and 7) are preferably provided and are disposed at the top of actuator arm assembly 136 (FIG. 2). Actuator arm assembly 136 acts similar to a tractor's three point hitch in that it will maintain a constant level of the implement as it is raised and lowered. In this application, it preferably functions to maintain a relatively constant angle with respect to the ground for both blades 126 and wheels 124. Linkage 140 (FIG. 4) preferably attaches actuator arm assembly 136 to rotating slide bars 130 and pivot points 129 off of the main frame assembly.

Figure 3:
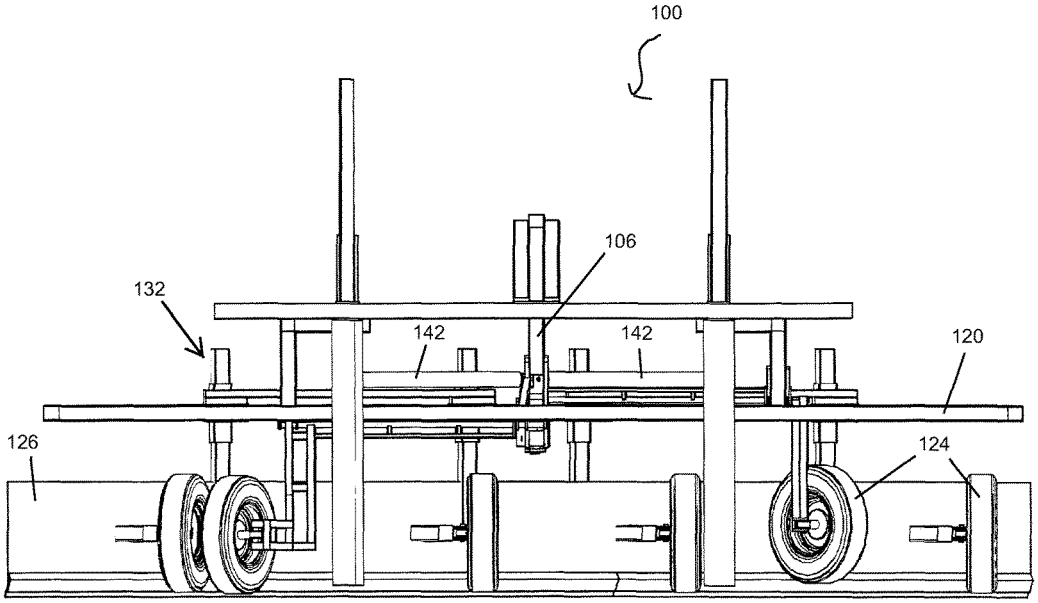

Wheels 124 (FIG. 3) are preferably used to support, at least partially, the weight of the rock blade 100 when it is in a down position. In one embodiment, a plurality of wheels 124 are attached to actuator arm assembly 136 through rotational transfer axels 138 (FIG. 5) and linkages. In this configuration, wheels 124 can thus fold up into a compact configuration with rock blade 100 when it is raised. Wheels 124 also preferably pivot when the haul truck carrying rock blade 100 is turned while rock blade 100 is in its down position. In one embodiment, each blade 126 is preferably held by two wheels 124 such that the blade 126 can ride above a road surface at a substantially constant height when in use. In one embodiment, two or more wheels 124 can also be provided to help support the weight of rock blade 100.

For embodiments wherein two blades are provided such that each blade takes up about half of the width of rock blade 100, blade guides 132 for each individual blade are preferably connected via slide bars 130 (FIG. 1) and slack adjusters 160. As best illustrated in FIGS. 36-39, slack adjuster 160 preferably is formed from upright posts 162 mounted atop horizontal rear portion 141 of blade guide 132 between which connecting member 164 extends. Preferably, connecting member 164 passes through slide tube 165 and slide tube 165 is preferably shorter than connecting member 164 such that slide tube 165 can slide back and forth about connecting member 164. In this embodiment, slack adjuster 160 automatically allows blade guides 132 to move apart in the horizontal plane. This prevents blade 126 from binding in blade guide 132 when the plane of the road changes.

Blade slide cylinders 142 (FIG. 1) preferably move blades 126 by shoving and/or pulling push bars 131 at slide cylinder attachment point 144. In this embodiment, cylinders 142 can be used to extend and/or retract each of blade 126 separately. This can be done, for example during turning to clear the turn radius path of spillage.

Figure 5:
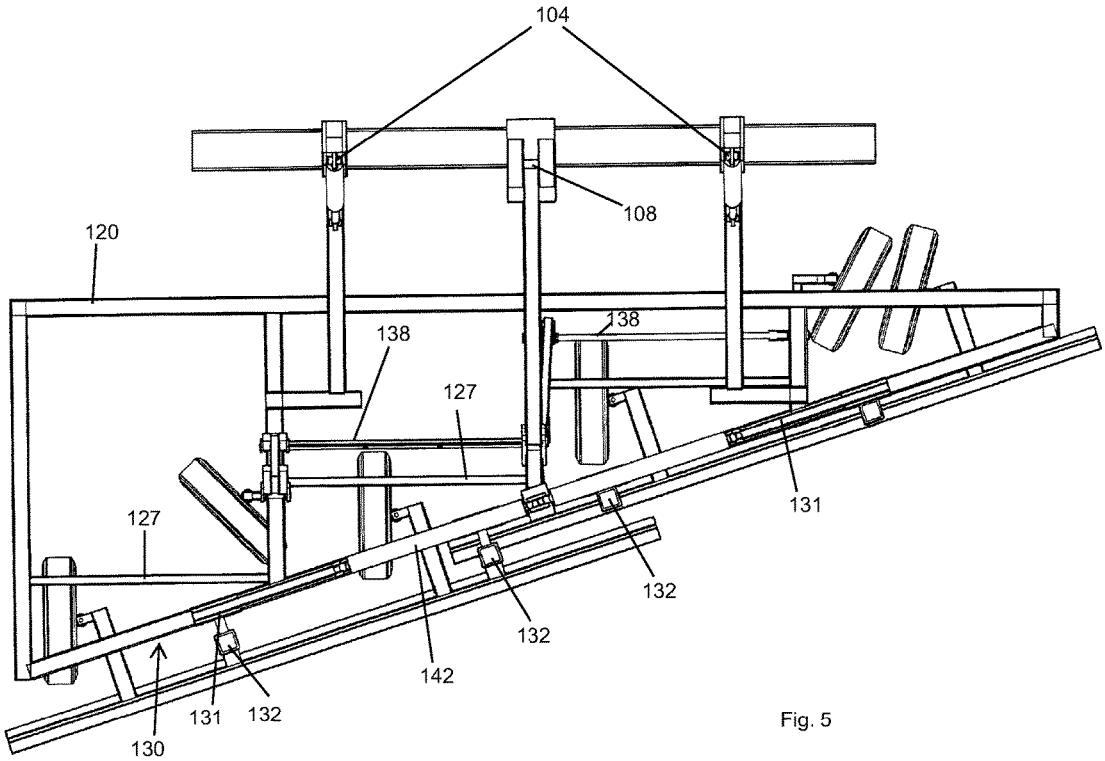

In one embodiment, blade guides 132 are preferably configured such that they can slide horizontally along at least a portion of the length of rotating slide bars 130 (FIG. 6). Blade guides 132 can also have pivot points 146 housed within them. In this configuration, rock blade 100 can undulate while traveling along an uneven road surface. In addition, this allows blades 126 to remain in a more horizontal position when rock blade 100 is in a lowered position and traveling across uneven ground. As best illustrated in FIG. 5, when two or more blades are provided, they are preferably offset from one another. In this embodiment, the blade guides 132 of one blade are preferably disposed a distance beyond support frame 120 of proximately 6 inches, while blade guides 132 of another blade are preferably disposed about 1 inch beyond support frame 120, thus causing the blades to be offset from one another and permit room for the blades to be shifted side-to-side with respect to one another and to be stowed in a narrower profile, while also allowing them to be extended to a wider profile when in use.

In one embodiment, blades 126 preferably ride within blade guides 132 and can preferably travel vertically therein, most preferably by at least about 6 to 24 inches and most preferably by about 12 inches. This configuration permits vertical travel of blades 126 to accommodate for undulation of rock blade 100. In one embodiment, the top of one or more blade guides 132 are provided with stop 148, (FIG. 7) which can be removable and/or movably positional.

Cutting blades 126 can optionally comprise wear plate 150 disposed along its cutting edge. For embodiments wherein two blades are provided, wheels 124 are preferably grouped such that each blade has a group of wheels which dictates that blades movements. The height of blades 126 is preferably adjustable by adjusting their position with respect to wheels 124. For example, adjustment 152, can be provided by use of a mechanical adjustment mechanism, such as a trailer jack-type of mechanism or simply by adding and/or removing one or more shims. In this manner, blades 126 can be adjusted such that they stay up off of the road surface, thus minimizing and only effect larger debris which lies on the roadway.

It is important to note that although the drawings illustrate a rock blade constructed for trucks which predominately operate under left-hand traffic, the same principals described herein can of course be used to construct rock blades which predominately operate under right-handed traffic. In one embodiment, the blade is preferably not raised unless both blade portions are fully retracted. In one embodiment, the tires for the blades can be afforded limited areas in which they will properly fold into the blade frame in the raised position.

Figure 30:
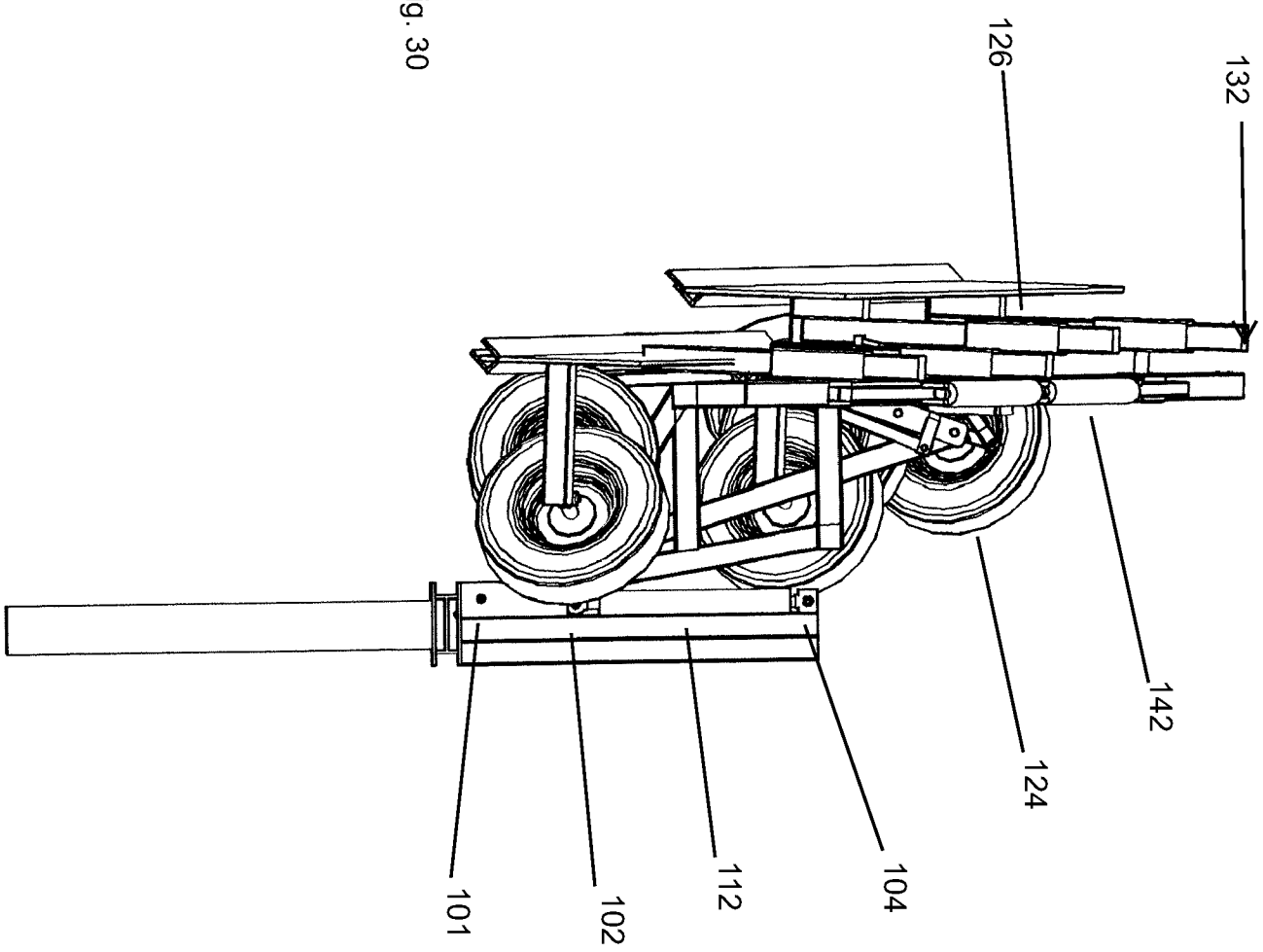
FIGS. 30 and 31 respectively illustrate side-view drawings of a rock blade in a raised and folded position in accordance with an embodiment of the present invention.
Figure 31:
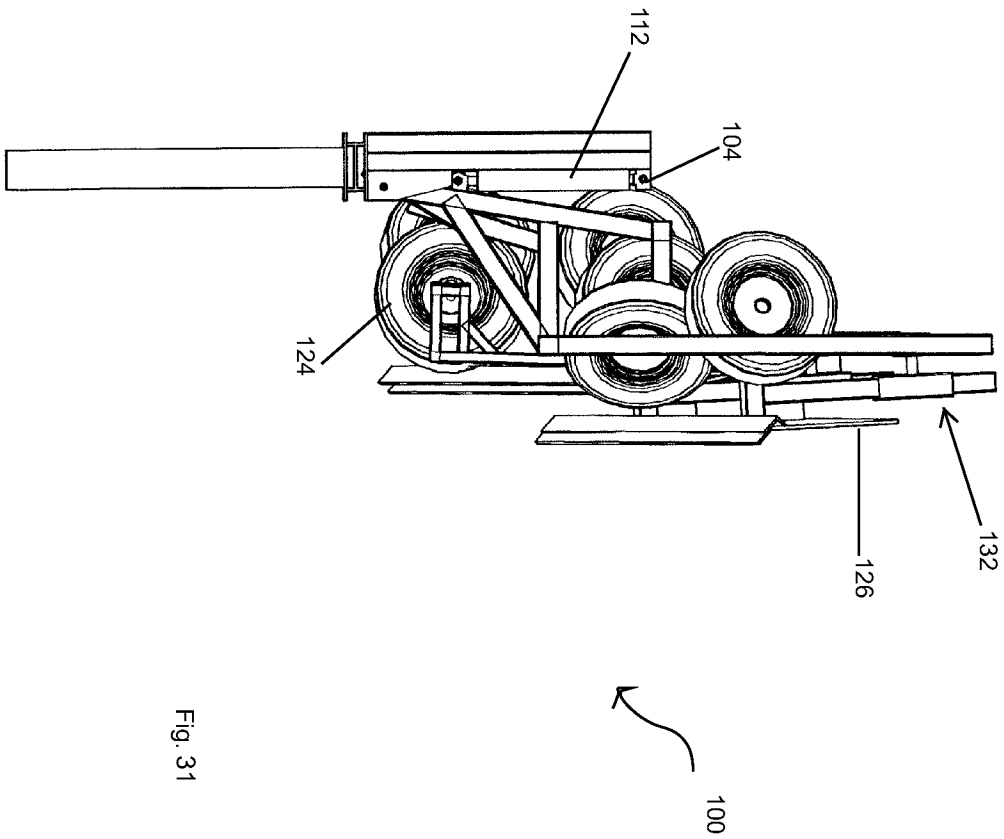

In one embodiment, rock blade 100 can be raised via activation of hoist cylinders 112. In this embodiment, as rock blade 100 is raised, wheels 124 preferably fold in such that rock blade 100 is stowed in a compact and folded state as best illustrated in FIGS. 30 and 31. Although the figures illustrate an embodiment of the invention wherein two blades are provided, rock blades can also be constructed in accordance with the teachings of the present invention wherein only 1 blade is provided. Likewise, rock blades can be constructed in accordance with the teachings of the present invention wherein 3 or more blades are provided.

In one embodiment, blades 126 are preferably positionable such that they do not contact the surface upon which the vehicle is traveling when rock blade 100 is in a fully-down position. In one embodiment, when rock blade 100 is in a fully down and operational position, blades 126 preferably contact only debris lying on a roadway and do not contact the roadway upon which the vehicle that carries rock blade 100 traverses. In one embodiment, when rock blade 100 is fully lowered, blades 126 do not remain at a constant elevation, but rather can undulate. In one embodiment, the pitch of blades 126 is fixed when rock blade 100 is in a fully down position. In one embodiment, rock blade 100 comprises mounts with dimensions which accommodate mounting onto the front of a haul truck 200. In one embodiment, rock blade 100 is not mountable on a rail-traveling vehicle. In one embodiment rock blade 100 comprises a plurality of blades 126 and blades 126 are preferably arranged in a substantially parallel relationship with one another. In one embodiment, blades 126 are at least substantially planar and are not curved. In one embodiment, rock blade 100 comprises a plurality of blades 126 and does not comprise a single blade. In one embodiment, wherein rock blade 100 comprises two blades 126, each of blades 126 are preferably independently movable with respect to frame 120 and each other. In one embodiment, rock blade 100 does not comprise ripper teeth nor other tooth-shaped members that depend downwardly from blades 126. In one embodiment wherein two or more blades 126 are provided, blades 126 do not roll with respect to one another (i.e. their primary axis remains substantially parallel with respect to one another and the blades thus cannot form a V-shape or inverted V-shape when viewed from in front of the blades). In one embodiment, wherein a plurality of blades 126 are provided, blades 126 preferably extend at least the full width of frame 120, such that no gaps exist between each of blades 126 when viewed from the rear (i.e. although blades 126 need not touch and can reside in off-set planes from one another, blades 126 can clear a continuous width when rock blade 100 is in operation). In one embodiment, the 126 are arranged substantially parallel with one another, but are not complainer. In one embodiment, none of the ends of one blade 126 are connected to any end of another blade 126 (i.e. although the blades may be connected by virtue of being mounted to the same frame 120, they are not connected on another in an end-to-end attachment configuration). In embodiments wherein two blades 126 are provided, they are preferably spaced apart by a distance of less than 24 inches, and most preferably less than about 10 inches.

Figure 40:
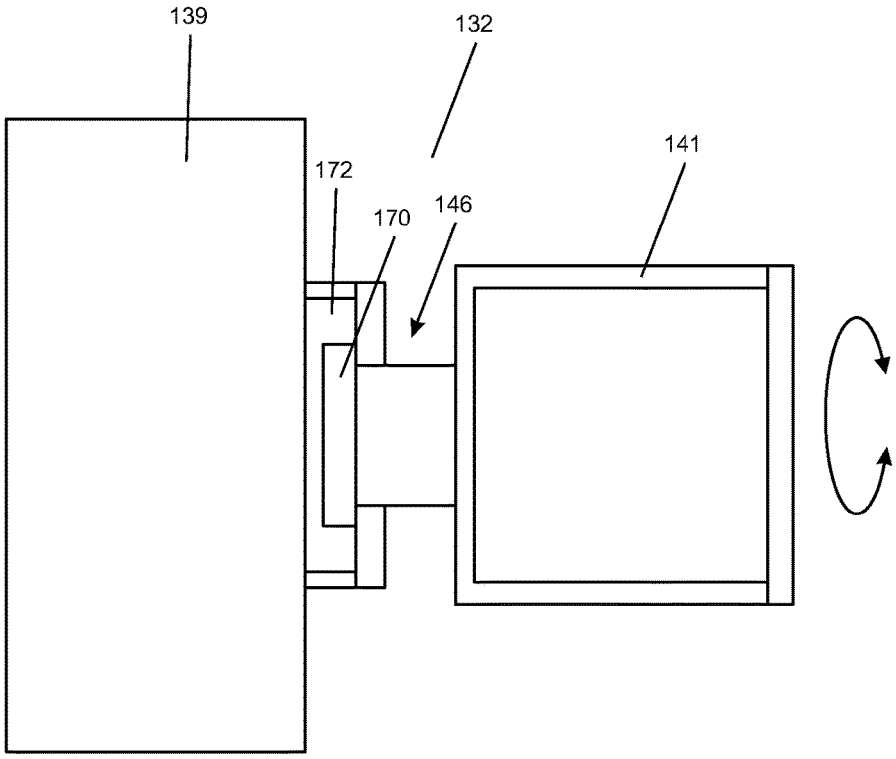
FIG. 40 is a drawing which illustrate a blade guide with a pivot point.

Referring now to FIG. 40, a cut-away view of a blade guide 132 is illustrated. As can be seen therein, pivot point 129 is preferably formed from a horizontal member having head 170 formed on an end thereof, which is retained within enclosure 172. Optionally, head 170 can comprise a washer or other flat plate welded onto the end of a horizontal shaft. As such, front, vertically orientated portion 139 can at least partially rotate with respect to horizontal rear portion 141 of blade guide 132

The preceding examples can be repeated with similar success by substituting the generically or specifically described components and/or operating conditions of embodiments of the present invention for those used in the preceding examples.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above are hereby incorporated by reference.

What is claimed is:

1. An apparatus comprising:

at least two wheels;

at least two blades movable independently with respect to one another and positioned such that a primary axis of each of said at least two blades is substantially parallel with one another;

said apparatus attachable to a vehicle;

an actuator arm assembly;

at least one rotational transfer axle;

at least one linkage, wherein at least one of said at least two wheels is communicably coupled to said actuator arm assembly through said rotational transfer axle and said linkage such that said at least one of said at least two wheels folds into a compact configuration when said apparatus is raised;

said at least two wheels and said at least two blades configured to be raised and lowered with respect to the vehicle;

an adjustment mechanism configured such that said at least two blades stay up off of a road surface on which the vehicle traverses when said at least two blades are in a lowered and operational state with respect to the vehicle;

at least one rotating slide bar;

at least two blade guides riding on said at least one rotating slide bar;

said blade guides each comprising:

a front portion;

a rear portion; and a pivot portion, said front portion at least partially rotatable with respect to said rear portion via said pivot portion;

said at least two blades configured to ride within said at least two blade guides and said at least two blades configured to travel vertically within said at least two blade guides;

a slack adjuster comprising:

a connecting member; and a slide tube, said connecting member passing through said slide tube;

said slack adjuster attached to at least one of said blade guides and configured to allow at least one of said blade guides to move apart from another of said blade guides;

one or more blade slide cylinders;

one or more push bars, said one or more blade slide cylinders connected to said one or more push bars; and said one or more blade cylinders configured to move at least one of said at least two blades by shoving or pulling said one or more push bars.

2. The apparatus of claim 1 wherein said at least two blades are substantially planar and are not curved.

3. The apparatus of claim 1 further comprising a frame.

4. The apparatus of claim 1 further comprising a plurality of hydraulic cylinders which raise and lower said apparatus with respect to the vehicle.

5. The apparatus of claim 1 wherein said one or more blade slide cylinders are configured to slide at least one of said at least two blades along a direction parallel with a primary axis of said blade.

6. The apparatus of claim 1 wherein said actuator arm assembly, said at least one linkage, and said rotational transfer axle are positioned to cause said at least one of said at least two wheels to fold up into a compact configuration with said apparatus.

7. The apparatus of claim 1 wherein said apparatus comprises a mounting structure which accommodates mounting onto a haul truck.

8. An apparatus comprising:

a plurality of blades, said plurality of blades arranged substantially parallel with one another but not arranged coplanar with one another, said apparatus attachable to a vehicle;

an actuator arm assembly;

at least one rotational transfer axle;

at least one wheel;

at least one linkage, wherein said at least one wheel is communicably coupled to said actuator arm assembly through said rotational transfer axle and said linkage such that said at least one wheel folds into a compact configuration when said apparatus is raised; and at least one adjustment mechanism configured such that said plurality of blades stay up off of a road surface on which the vehicle traverses when said plurality of blades are in a lowered and operational state with respect to the vehicle;

at least one rotating slide bar;

at least two blade guides riding on said at least one rotating slide bar;

said blade guides each comprising:

a front portion;

a rear portion; and a pivot portion, said front portion at least partially rotatable with respect to said rear portion via said pivot portion;

said plurality of blades configured to ride within said at least two blade guides and said plurality of blades configured to travel vertically within said at least two blade guides;

a slack adjuster comprising:

a connecting member; and a slide tube, said connecting member passing through said slide tube;

said slack adjuster attached to at least one of said blade guides and configured to allow at least one of said blade guides to move apart from another of said blade guides;

one or more blade slide cylinders;

one or more push bars, said one or more blade slide cylinders connected to said one or more push bars; and said one or more blade cylinders configured to move at least one of said plurality of blades by shoving or pulling said one or more push bars.

9. The apparatus of claim 8 wherein said at least one wheel comprises a plurality of wheels.

10. The apparatus of claim 9 wherein said plurality of wheels comprises at least 4 wheels.

11. The apparatus of claim 8 further comprising one or more lift cylinders, said one or more lift cylinders raising and lowering said apparatus with respect to the vehicle.

12. The apparatus of claim 8 wherein said plurality of blades comprises exactly two blades.

13. The apparatus of claim 8 wherein said plurality of blades are mounted such that said plurality of blades can be raised and lowered together and yet remain independently movable with respect to one another.

14. The apparatus of claim 11 wherein said actuator arm assembly, said at least one linkage, and said rotational transfer axle are positioned to cause said at least one wheel to fold up into a compact configuration with said apparatus.

15. An apparatus comprising:

a mining haul truck;

a rock blade apparatus comprising:

an actuator arm assembly;

at least one rotational transfer axle;

at least one wheel;

at least one linkage, wherein said at least one wheel is communicably coupled to said actuator arm assembly through said rotational transfer axle and said linkage such that said at least one wheel folds into a compact configuration when said rock blade apparatus is raised;

a mount, attached to said mining haul truck;

at least two blades communicably coupled to said mount; and an adjustment mechanism configured such that said at least two blades stay up off of a road surface on which said mining haul truck travels when said at least two blades are in a lowered and operational state;

at least one rotating slide bar;

at least two blade guides riding on said at least one rotating slide bar;

said blade guides each comprising:

a front portion;

a rear portion; and a pivot portion, said front portion at least partially rotatable with respect to said rear portion via said pivot portion;

said at least two blades configured to ride within said at least two blade guides and said at least two blades configured to travel vertically within said at least two blade guides;

a slack adjuster comprising:

a connecting member; and a slide tube, said connecting member passing through said slide tube;

said slack adjuster attached to at least one of said blade guides and configured to allow at least one of said blade guides to move apart from another of said blade guides;

one or more blade slide cylinders;

one or more push bars, said one or more blade slide cylinders connected to said one or more push bars; and said one or more blade cylinders configured to move at least one of said at least two blades by shoving or pulling said one or more push bars.

16. The apparatus of claim 15 wherein said one or more blade cylinders are configured to cause at least one of said at least two blades traverse in a direction aligned substantially parallel with a primary axis of said at least one of said at least two blades.

17. The apparatus of claim 15 wherein said at least one wheel comprises a plurality of wheels.

18. The apparatus of claim 15 wherein said rock blade apparatus further comprises a hydraulic lift cylinder.

* * * * *